US008600270B2

(12) United States Patent
Nishiwaki

(10) Patent No.: US 8,600,270 B2
(45) **Date of Patent: *Dec. 3, 2013**

(54) DEVELOPER TRANSPORT SUBSTRATE CONFIGURATION FOR AN IMAGE FORMING APPARATUS

(75) Inventor: Kenjiro Nishiwaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 832 days.

This patent is subject to a terminal disclaimer.

(21) Appl. No.: 12/307,006

(22) PCT Filed: Jun. 26, 2007

(86) PCT No.: PCT/JP2007/063203

§ 371 (c)(1),
(2), (4) Date: Sep. 21, 2009

(87) PCT Pub. No.: WO2008/004508

PCT Pub. Date: Jan. 10, 2008

(65) Prior Publication Data

US 2010/0028056 A1 Feb. 4, 2010

(30) Foreign Application Priority Data

Jul. 4, 2006 (JP) ..... 2006-184691
Jul. 25, 2006 (JP) ..... 2006-201493

(51) Int. Cl.
*G03G 15/08* (2006.01)

(52) U.S. Cl.
USPC ..... 399/266

(58) Field of Classification Search
USPC ..... 399/241, 242, 244, 265, 266, 289–293; 347/140, 158
See application file for complete search history.

(56) References Cited

U.S. PATENT DOCUMENTS

| | | | |
|---|---|---|---|
| 4,558,941 | A | 12/1985 | Nosaki et al. |
| 4,598,991 | A | 7/1986 | Hosoya et al. |
| 6,934,496 | B2 | 8/2005 | Sakuma et al. |

FOREIGN PATENT DOCUMENTS

| | | | |
|---|---|---|---|
| JP | 59-181375 | | 10/1984 |
| JP | 63-013074 | | 1/1988 |
| JP | 05-031146 | | 5/1993 |
| JP | 2002-091160 | | 3/2002 |
| JP | 2002-351218 | | 12/2002 |
| JP | 2003-015417 | | 1/2003 |
| JP | 2004-157259 | | 6/2004 |
| JP | 2004205644 | A * | 7/2004 |
| JP | 2004-340996 | | 12/2004 |
| JP | 2005-275127 | | 10/2005 |

OTHER PUBLICATIONS

International Search Report for PCT/JP2007/063203.

* cited by examiner

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

A developer transport body transports a developer on a transport surface in a predetermined direction. This transport surface is composed of a first constituent surface which renders relatively large the absolute value of a charge amount of the developer due to friction, and a second constituent surface disposed in an area downstream of and adjacent to the first constituent surface and which renders the absolute value of the charge amount of the developer smaller than if the first constituent surface was disposed in the area. Therefore, when the developer is moved toward a latent-image forming surface by electrostatic force, the developer is less likely to be affected by disturbing forces other than the electrostatic force. Further, since the absolute value of the charge amount of the developer becomes smaller on the second constituent surface, adhesion of the developer to the transport surface and aggregation of the developer can be restrained.

9 Claims, 16 Drawing Sheets

DEVELOPER TRANSPORT SUBSTRATE CONFIGURATION FOR AN IMAGE FORMING APPARATUS

TECHNICAL FIELD

The present invention relates to a developer transport body which transports a developer by means of an electric field so as to cause the developer to adhere to a surface of a latent-image carrying body on which an electrostatic latent image is formed, a process unit which includes the developer transport body, and an image forming apparatus which includes the process unit.

Also, the present invention relates to an electric field developer transport apparatus, a developer supply apparatus, and an image forming apparatus.

BACKGROUND ART

[1] A developing apparatus (process unit) including a developer transport body has conventionally been known. The developer transport body includes a substrate having a transport surface disposed to face a latent-image forming surface, which is a surface of a latent-image carrying body and on which an electrostatic latent image is formed by means of electric potential of the surface; and a plurality of electrodes disposed on the substrate.

In such a developing apparatus, an electric field directed toward a predetermined developer transport direction is formed on the transport surface through application of voltages to the electrodes. Thus, a charged developer (toner) on the transport surface moves along the transport surface in the developer transport direction. When the developer reaches a developing area in the vicinity of the latent-image forming surface, the developer is caused to move toward the latent-image forming surface by means of an electrostatic force which is produced through interaction between a charge (charge amount) of the developer and an electric field generated by a difference (difference in electrical potential) between the electrical potential of the latent-image forming surface and that of the transport surface. As a result of the developer having reached the latent-image forming surface and adhering thereto, an image in the developer is formed (developed) on the latent-image forming surface (see, for example, Japanese Patent Application Laid-Open (kokai) No. S59-181375).

Incidentally, when the developer moves from the transport surface to the latent-image forming surface, the developer receives a force (disturbing force), other than the above-mentioned electrostatic force, which is produced by a flow of air or the like. If such a disturbing force is sufficiently smaller than the electrostatic force, the developer can easily move in the direction of the electrostatic force. In such a case, the developer can be caused, without fail, to reach proper positions on the latent-image forming surface in accordance with the electric potential thereof, whereby the quality of an image formed by the developer can be improved. Therefore, conceivably, sufficiently increasing the absolute value (magnitude) of the charge amount of the developer is desired so as to sufficiently increase the electrostatic force.

However, the greater the absolute value of the charge amount of the developer, the greater the risk of the developer adhering to the transport surface due to image force, etc., or the developer aggregating. Therefore, the greater the absolute value of the charge amount of the developer, the greater the possibility that the developer on the transport surface is not transport smoothly. As a result, the developer is non-uniformly distributed in the developing area, whereby the quality of an image formed on the latent-image forming surface may deteriorate.

[2] Many mechanisms for transporting toner (developer) in an image forming apparatus by use of a traveling-wave electric field are conventionally known (as disclosed in, for example, Japanese Patent Application Laid-Open (kokai) No. S63-13074, Japanese Patent Publication (kokoku) No. H5-31146, and Japanese Patent Application Laid-Open (kokai) Nos. 2002-351218, 2003-15417, 2004-157259, 2005-275127, etc.) In such a mechanism, a large number of strip-shaped electrodes are juxtaposed in a row on an electrically insulative base plate.

In such a mechanism, polyphase AC voltages are sequentially applied to the plurality of strip-shaped electrodes, whereby a traveling-wave electric field is generated. By the action of the traveling-wave electric field, the above-described toner in a charged state is transported in a predetermined direction.

The above-described mechanism which can transport a charged developer by means of a traveling-wave electric field (hereinafter referred to as an "electric field developer transport apparatus" in some cases) has the following problem. When the developer is not smoothly transported in a certain region on the base plate, the developer may stagnate in that region for a long period of time. This stagnation of the developer may cause adhesion of the developer to the base plate and/or scattering of the developer to the outside.

DISCLOSURE OF THE INVENTION

[1] The present invention has been conceived for solving the above-mentioned problems, and one object of the invention is to provide a developer transport body which can improve the quality of an image formed on a latent-image forming surface by use of a developer.

In order to achieve the above-described object, a developer transport body according to the present invention comprises:

a substrate having a transport surface that faces a latent-image forming surface, which is a surface of a latent-image carrying body and on which an electrostatic latent image is formed by electrical potential of the surface; and transport-electric-field forming means for forming an electric field for transporting a developer supplied onto the transport surface from a predetermined upstream area toward a predetermined downstream area such that the developer passes through a closest proximity position, which is a position on the transport surface where which the distance between the transport surface and the latent-image forming surface becomes the shortest.

Further, the transport surface includes a first constituent surface which charges the developer through contact with the developer, a downstream end portion of the first constituent surface with respect to a developer transport direction, which is a direction directed from the upstream area toward the downstream area, being located within a predetermined area including the closest proximity position; and a second constituent surface disposed in an adjacent area which is located downstream of the first constituent surface with respect to the developer transport direction and adjacent to the first constituent surface, the second constituent surface rendering the absolute value of a charge amount of the developer in the adjacent area smaller than that in an assumed case where the first constituent surface is disposed in the adjacent area.

According to this configuration, the first constituent surface is disposed such that its downstream end portion with respect to the developer transport direction is located in the vicinity of the closest proximity position, and the second constituent surface is disposed to follow the first constituent surface. When the developer passes through the area (first area) in which the first constituent surface is disposed, the developer comes into contact with the first constituent surface, whereby the developer is charged. In the vicinity of the closest proximity position, the developer is moved toward the latent-image forming surface by means of an electrostatic force which is produced through interaction between a charge (charge amount) of the developer and a relatively strong electric field produced due to a difference (potential difference) between the potential of the latent-image forming surface and that of the transport surface. The developer then reaches and adheres to the latent-image forming surface, whereby an image in the developer is formed on the latent-image forming surface.

Meanwhile, in the area (second area) in which the second constituent surface is disposed, the absolute value of the charge amount of the developer becomes smaller than that in the assumed case where the first constituent surface is disposed in that area. Accordingly, even when the absolute value of the charge amount of the developer is rendered relatively large in the first area, in the second area, the developer can be restrained from adhering to the transport surface or aggregating. Therefore, the developer on the transport surface can be transported smoothly. As a result, the developer can be prevented from being non-uniformly distributed in the vicinity of the closest proximity position, whereby a decrease in the quality of an image formed on the latent-image forming surface by use of the developer can be prevented.

In other words, since the absolute value of the charge amount of the developer can be rendered large in the first area, the developer can be moved in the direction of the above-mentioned electrostatic force irrespective of forces other than the electrostatic force (disturbing forces). As a result, the developer can be caused to adhere to proper portions of the latent-image forming surface corresponding to the electrostatic latent image. That is, the quality of an image formed on the latent-image forming surface by use of the developer can be improved.

In this case, preferably, the downstream end portion of the first constituent surface with respect to the developer transport direction is located within a projection area, which is formed on the transport surface by means of projecting the latent-image carrying body onto the transport surface in a projection direction parallel to a line which passes through a position on the latent-image forming surface where the distance between the transport surface and the latent-image forming surface becomes the shortest, and the closest proximity position.

In an area where the distance between the transport surface and the latent-image forming surface becomes relatively short, the electric field produced due to the difference between the potential of the latent-image forming surface and that of the transport surface becomes relatively strong. Further, the above-mentioned projection area is an area where the distance between the transport surface and the latent-image forming surface is relatively short. Accordingly, the developer within the projection area can be easily moved from the transport surface toward the latent-image forming surface.

In view of the above, the downstream end portion of the first constituent surface with respect to the developer transport direction is located in the projection area, as in the above-described configuration. Thus, the absolute value of the charge amount of the developer can be rendered relatively large at least in a portion of the projection area. Since the developer which is large in the absolute value of the charge amount reaches and adheres to the latent-image forming surface, the quality of an image formed on the latent-image forming surface by use of the developer can be improved.

Moreover, since the second constituent surface is disposed in an area located downstream of the projection area with respect to the developer transport direction, the absolute value of the charge amount of the developer becomes smaller than that in the assumed case where the first constituent surface is disposed in that area. As a result, adhesion of the developer to the transport surface and aggregation of the developer can be restrained, whereby the developer on the transport surface can be transported smoothly.

In this case, preferably, the developer transport body is accommodated within an enclosure having a hole forming wall in which a developer passage hole is formed to extend through the hole forming wall;

the hole forming wall is disposed between the latent-image forming surface and the transport surface such that the developer passage hole faces the transport surface and such that a straight line passing through the closest proximity position and a position on the latent-image forming surface where the distance between the transport surface and the latent-image forming surface becomes the shortest passes through the developer passage hole; and the downstream end portion of the first constituent surface with respect to the developer transport direction is located in a developer-passage-hole facing area where the transport surface faces the developer passage hole (an area formed on the transport surface by means of projecting the developer passage hole onto the transport surface in the above-mentioned projection direction).

Like the projection area, the developer-passage-hole facing area is an area where the distance between the transport surface and the latent-image forming surface is relatively short. Accordingly, in the developer-passage-hole facing area, the electric field produced due to the difference between the potential of the latent-image forming surface and that of the transport surface becomes relatively strong, so that the developer can be easily moved from the transport surface toward the latent-image forming surface.

Moreover, when the developer within the developer-passage-hole facing area moves toward the latent-image forming surface, movement of the developer is not hindered by the hole forming wall of the enclosure. In view of the above, as in the above-described configuration, the downstream end portion of the first constituent surface with respect to the developer transport direction is located in the developer-passage-hole facing area. Thus, the absolute value of the charge amount of the developer can be rendered relatively large at least in a portion of the developer-passage-hole facing are. Since the developer which is large in the absolute value of the charge amount passes through the developer passage hole, reaches the latent-image forming surface, and adheres thereto, the quality of an image formed on the latent-image forming surface by use of the developer can be improved.

In this case, preferably, the downstream end portion of the first constituent surface with respect to the developer transport direction is located at the closest proximity position or downstream of the closest proximity position with respect to the developer transport direction.

Since the distance between the transport surface and the latent-image forming surface becomes the shortest at the closest proximity position, the electric field produced due to the difference between the potential of the latent-image forming surface and that of the transport surface becomes the strongest. Accordingly, in the vicinity of the closest proximity position, the developer can be easily moved from the transport surface toward the latent-image forming surface.

In view of the above, as in the above-described configuration, the downstream end portion of the first constituent surface with respect to the developer transport direction is located at the closest proximity position or downstream of the closest proximity position with respect to the developer transport direction. Thus, the absolute value of the charge amount of the developer can be rendered relatively large at least the closest proximity position. Since the developer which is large in the absolute value of the charge amount reaches the latent-image forming surface and adheres thereto, the quality of an image formed on the latent-image forming surface by use of the developer can be improved.

In this case, preferably, the substrate constitutes at least one of the first constituent surface and the second constituent surface by a surface film formed on the surface of the substrate.

According to such a configuration, there can be readily formed a transport surface which varies, in terms of the degree of charging of the developer (charging characteristic), in accordance with the position on a single member (substrate).

Another object of the present invention is to provide a process unit which can improve the quality of an image formed on a latent-image forming surface by use of a developer.

In order to achieve such an object, a process unit according to the present invention comprises:

any of the above-described developer transport bodies; and the latent-image carrying body, wherein the process unit supplies the transported developer onto the latent-image forming surface, to thereby form an image in the developer on the latent-image forming surface.

According to this configuration, as described above, the absolute value of the charge amount of the developer can be rendered relatively large in the area (first area) in which the first constituent surface is disposed. Thus, the developer can be moved in the direction of the electrostatic force irrespective of forces other than the electrostatic force (disturbing forces). Accordingly, the developer can be caused to adhere to proper portions of the latent-image forming surface corresponding to the electrostatic latent image. That is, the quality of an image formed on the latent-image forming surface by use of the developer can be improved.

Meanwhile, in the area (second area) in which the second constituent surface is disposed, the absolute value of the charge amount of the developer becomes smaller than that in the assumed case where the first constituent surface is disposed in that area. Accordingly, in the second area, the developer can be restrained from adhering to the transport surface or aggregating. Therefore, the developer on the transport surface can be transported smoothly.

As described above, according to the present process unit, the quality of an image in the developer formed on the latent-image forming surface in accordance with an electrostatic latent image can be improved.

Still another object of the present invention is to provide an image forming apparatus which can improve the quality of an image formed on a recording medium by use of a developer.

In order to achieve such an object, an image forming apparatus according to the present invention comprises:

any of the above-described developer transport bodies;

the latent-image carrying body;

electrostatic-latent-image forming means for forming on the latent-image forming surface the electrostatic latent image for adhering the developer to a predetermined position on the latent-image forming surface by means of an electrostatic force; and image forming means for transferring the image formed on the latent-image forming surface by use of the developer to a recording medium to thereby form an image on the recording medium.

According to this configuration, as described above, the quality of an image formed on the latent-image forming surface by use of the developer can be improved, whereby the quality of an image formed on a recording medium through transfer of the developer image to the recording medium can be improved.

[2] The present invention has been accomplished in order to solve the above-described problem. That is, an object of the present invention is to provide an electric field developer transport apparatus which can smoothly transport a developer in a predetermined direction by means of traveling waves, and a developer supply apparatus and an image forming apparatus which include the electric field developer transport apparatus.

(1) An image forming apparatus of the present invention comprises an electrostatic-latent-image carrying body and a developer supply apparatus.

The electrostatic-latent-image carrying body has a latent-image forming surface. The latent-image forming surface is formed in parallel with a predetermined main scanning direction, and configured such that an electrostatic latent image in the form of an electric potential distribution is formed thereon. The electrostatic-latent-image carrying body is configured such that the latent-image forming surface can move along a sub-scanning direction orthogonal to the main scanning direction.

The developer supply apparatus is disposed to face the electrostatic-latent-image carrying body. The developer supply apparatus is configured to supply a charged developer onto the latent-image forming surface.

In the present invention, the developer supply apparatus includes a developer transport body and an electrical charge draining member.

The developer transport body has a developer transport surface parallel with the main scanning direction. The developer transport body is disposed such that the developer transport surface faces the electrostatic-latent-image carrying body.

A plurality of transport electrodes are arrayed along the sub-scanning directions. These transport electrodes are provided along the developer transport surface. These transport electrodes are configured and disposed such that, when traveling-wave voltages are applied to the transport electrodes, the transport electrodes can transport the developer in a predetermined developer transport direction.

The electrical charge draining member is disposed such that the electrical charge draining member faces the developer transport surface on the upstream side and/or the downstream side, with respect to the developer transport direction, of a closest proximity position where the distance between the latent-image forming surface and the developer transport surface becomes the shortest. The electrical charge draining member is configured so as to be able to restrain charge up on the developer transport surface through aerial discharge.

For example, the electrical charge draining member can be provided to face a facing area of the developer transport surface in which the developer transport surface faces the electrostatic-latent-image carrying body. Further, a first electrical charge draining member can be provided on the upstream side of the closest proximity position with respect to the developer transport direction, and a second electrical charge draining member can be provided on the downstream side of the closest proximity position with respect to the developer transport direction.

The image forming apparatus of the present invention having the above-described configuration operates as follows at the time of image formation.

The electrostatic latent image in the form of an electric potential distribution is formed on the latent-image forming surface of the electrostatic-latent-image carrying body. The latent-image forming surface on which the electrostatic latent image is formed moves in the sub-scanning direction.

Predetermined traveling-wave voltages are applied to the plurality of transport electrodes provided along the developer transport surface of the developer transport body provided in the developer supply apparatus. Thus, the charged developer moves on the developer transport surface in the developer transport direction.

The latent-image forming surface and the developer transport surface are surfaces parallel with the main scanning direction. Therefore, the latent-image forming surface and the developer transport surface can face in parallel with each other in the vicinity of the closest proximity position where the distance between the latent-image forming surface and the developer transport surface becomes the shortest. In the vicinity of the closest proximity position, the electrostatic latent image is developed by the charged developer having been transported on the developer transport body.

Incidentally, when the developer is transported on the developer transport surface, the developer transport surface and the developer come into friction engagement with each other. Due to this friction engagement, the developer transport surface may be charged. The amount of frictional charge on the developer transport surface may increase as a result of transport of the developer on the developer transport surface. That is, the developer transport surface may be charged up. If such charge up occurs, the developer cannot be smoothly transported on the developer transport surface.

In view of the above, in the image forming apparatus of the present invention, the electrical charge draining member restrains charge up of the developer transport surface on the upstream side and/or downstream side of the closest proximity position with respect to the developer transport direction. For example, during a non-developing period in which development of the electrostatic latent image is not performed (specifically, after completion of development of the electrostatic latent image), the operation of restraining the charge up of the developer transport surface (hereinafter referred to as "electrical charge draining of the developer transport surface") is performed.

According to such a configuration, transport of the developer toward the vicinity of the closest proximity position and transport of the developer from the vicinity of the closest proximity position toward the downstream side with respect to the developer transport direction can be performed smoothly.

The image forming apparatus may further comprise an electricity supply section for transport which supplies electricity to the transport electrodes, an electricity supply section for electrical charge draining which supplies electricity to the electrical charge draining member, and a control section for controlling operations of the electricity supply section for transport and the electricity supply section for electrical charge draining. The control section controls the electricity supply section for transport and the electricity supply section for electrical charge draining in such a manner that supply of electricity to the transport electrodes located upstream of the electrical charge draining member with respect to the developer transport direction is stopped when electricity is supplied to the electrical charge draining member.

The control section may be configured to control the electricity supply section for transport and the electricity supply section for electrical charge draining in such a manner that electricity is supplied to at least the transport electrodes located downstream of the electrical charge draining member with respect to the developer transport direction when electricity is supplied to the electrical charge draining member.

In the image forming apparatus having such a configuration, the electricity supply section for transport applies the above-mentioned traveling-wave voltages to the transport electrodes. Further, the electricity supply section for electrical charge draining supplies electricity to the electrical charge draining member for electrical charge draining of the developer transport surface. The control section controls operations of the electricity supply section for transport and the electricity supply section for electrical charge draining. Further, the control section controls the electricity supply section for transport and the electricity supply section for electrical charge draining in such a manner that supply of electricity to the transport electrodes located upstream of the electrical charge draining member with respect to the developer transport direction is stopped when electricity is supplied to the electrical charge draining member.

In this case, the above-mentioned traveling-wave voltages can be supplied to at least the transport electrodes located downstream of the electrical charge draining member with respect to the developer transport direction. For example, the above-mentioned traveling-wave voltages can be supplied to the transport electrodes in an electrical charge draining area and to the transport electrodes located downstream of the electrical charge draining area with respect to the developer transport direction. The electrical charge draining area refers to an area of the developer transport surface which is located in the vicinity of a position where the distance between the developer transport surface and the electrical charge draining member becomes the shortest and where the electrical charge draining member drains electrical charge from the developer transport surface.

As described above, the present image forming apparatus may be configured such that the first electrical charge draining member is provided on the upstream side of the closest proximity position with respect to the developer transport direction, and the second electrical charge draining member is provided on the downstream side of the closest proximity position with respect to the developer transport direction. In such a case, the control section controls the electricity supply section for transport and the electricity supply section for electrical charge draining in such a manner that supply of electricity to the transport electrodes located most upstream with respect to the developer transport direction and located upstream of the first electrical charge draining member is stopped when electricity is supplied to the electrical charge draining members.

In this case, the above-mentioned traveling-wave voltages can be supplied to at least the transport electrodes located downstream of the first electrical charge draining member with respect to the developer transport direction. That is, the above-mentioned traveling-wave voltages can be supplied to the transport electrodes in the electrical charge draining area of the first electrical charge draining member and to the transport electrodes located downstream of the electrical charge draining area with respect to the developer transport direction.

By virtue of such a configuration, at the time of electrical charge draining of the developer transport surface, successive transport of the developer to the electrical charge draining area is restrained. Thus, electrical charge draining of the developer transport surface can be performed efficiently. Further, electrical charge is properly drained from the developer located in the electrical charge draining area. Therefore, the developer which electrostatically and strongly adheres to the developer transport surface can be removed smoothly from the developer transport surface without imposing a mechanical load such as friction thereto.

The image forming apparatus may further comprise a grid electrode interposed between the developer transport surface and the electrical charge draining member. That is, the electrical charge draining member and the grid electrode can constitute a scorotron-type discharger. By virtue of such a configuration, electrical charge draining of the developer transport surface can be performed more stably.

The image forming apparatus may further comprise an electricity supply section for grid which supplies electricity to the grid electrode. In this case, the above-described control section is configured to control the electricity supply section for grid so as to set a potential of the grid electrode to the same polarity as the charging polarity of the developer when electricity is supplied to the transport electrodes while supply of electricity to the electrical charge draining member is stopped.

By virtue of such a configuration, for example, in a development period in which the electrostatic latent image is developed, the grid electrode is set to a potential whose polarity is the same as the charging polarity of the developer. Thus, undesired lifting of the developer from the developer transport surface can be restrained. Further, adhesion of the developer to the grid electrode can be restrained.

(2) A developer supply apparatus of the present invention is configured to supply to a developer-image carrying body a developer in a charged state along a predetermined developer transport direction.

The developer carrying body has a developer-image carrying surface. This developer-image carrying surface is a surface which can carry an image formed by the developer and which is parallel with a predetermined main scanning direction. The developer-image carrying surface can move along a sub-scanning direction orthogonal to the main scanning direction.

Specifically, for example, an electrostatic-latent-image carrying body having a latent-image forming surface configured such that an electrostatic latent image in the form of an electric-potential distribution can be formed on the surface can be used as the developer-image carrying body. Alternatively, for example, a recording medium (paper) transported along the sub-scanning direction can be used as the developer-image carrying body. Alternatively, for example, an intermediate transfer body configured and disposed such that the intermediate transfer body faces the recording medium and can transfer the developer onto the recording medium can be used as the developer-image carrying body.

The developer supply apparatus of the present invention includes a developer transport body and an electrical charge draining member.

The developer transport body has a developer transport surface parallel with the main scanning direction. The developer transport body is disposed such that the developer transport surface faces the developer-image carrying body.

A plurality of transport electrodes are arrayed along the sub-scanning directions. These transport electrodes are provided along the developer transport surface. These transport electrodes are configured and disposed such that, when traveling-wave voltages are applied to the transport electrodes, the transport electrodes can transport the developer in a predetermined developer transport direction.

The electrical charge draining member is disposed such that the electrical charge draining member faces the developer transport surface on the upstream side and/or the downstream side, with respect to the developer transport direction, of a closest proximity position where the distance between the developer-image carrying surface and the developer transport surface becomes the shortest. The electrical charge draining member is configured so as to be able to restrain charge up on the developer transport surface through aerial discharge.

For example, the electrical charge draining member can be provided to face a facing area of the developer transport surface in which the developer transport surface faces the developer-image carrying body. Further, a first electrical charge draining member can be provided on the upstream side of the closest proximity position with respect to the developer transport direction, and a second electrical charge draining member can be provided on the downstream side of the closest proximity position with respect to the developer transport direction.

The developer supply apparatus of the present invention having the above-described configuration operates as follows.

Predetermined traveling-wave voltages are applied to the plurality of transport electrodes provided along the developer transport surface. Thus, the charged developer moves on the developer transport surface in the developer transport direction.

The developer-image carrying surface and the developer transport surface are surfaces parallel with the main scanning direction. Therefore, the developer-image carrying surface and the developer transport surface can face in parallel with each other in the vicinity of the closest proximity position where the distance between the developer-image carrying surface and the developer transport surface becomes the shortest. In the vicinity of the closest proximity position, an image in the charged developer having been transported on the developer transport body is formed and carried on the developer-image carrying surface.

In the developer supply apparatus of the present invention, the electrical charge draining member restrains charge up of the developer transport surface on the upstream side and/or downstream side of the closest proximity position with respect to the developer transport direction. For example, during a non-image forming period in which an image in the developer is not formed on the developer-image carrying surface (specifically, after completion of formation of the image), electrical charge draining of the developer transport surface is performed.

According to such a configuration, transport of the developer on the developer transport surface can be performed smoothly.

The developer supply apparatus may further comprise an electricity supply section for transport which supplies electricity to the transport electrodes, an electricity supply section for electrical charge draining which supplies electricity to the electrical charge draining member, and a control section which controls operations of the electricity supply section for transport and the electricity supply section for electrical charge draining. The control section controls the electricity supply section for transport and the electricity supply section for electrical charge draining in such a manner that supply of electricity to the transport electrodes located upstream of the electrical charge draining member with respect to the developer transport direction is stopped when electricity is supplied to the electrical charge draining member.

The control section may be configured to control the electricity supply section for transport and the electricity supply section for electrical charge draining in such a manner that electricity is supplied to at least the transport electrodes located downstream of the electrical charge draining member with respect to the developer transport direction when electricity is supplied to the electrical charge draining member.

In the developer supply apparatus having such a configuration, the electricity supply section for transport applies the above-mentioned traveling-wave voltages to the transport electrodes. Further, the electricity supply section for electrical charge draining supplies electricity to the electrical charge draining member for electrical charge draining of the developer transport surface. The control section controls operations of the electricity supply section for transport and the electricity supply section for electrical charge draining. Further, the control section controls the electricity supply section for transport and the electricity supply section for electrical charge draining in such a manner that supply of electricity to the transport electrodes located upstream of the electrical charge draining member with respect to the developer transport direction is stopped when electricity is supplied to the electrical charge draining member.

In this case, the above-mentioned traveling-wave voltages can be supplied to at least the transport electrodes located downstream of the electrical charge draining member with respect to the developer transport direction. For example, the above-mentioned traveling-wave voltages can be supplied to the transport electrodes in the electrical charge draining area and the transport electrodes located downstream of the electrical charge draining area with respect to the developer transport direction.

As described above, the present developer supply apparatus may be configured such that the first electrical charge draining member and the second electrical charge draining member are provided. In such a case, the control section controls the electricity supply section for transport and the electricity supply section for electrical charge draining in such a manner that supply of electricity to the transport electrodes located most upstream with respect to the developer transport direction and located upstream of the first electrical charge draining member is stopped when electricity is supplied to the electrical charge draining members.

In this case, the above-mentioned traveling-wave voltages can be supplied to at least the transport electrodes located downstream of the first electrical charge draining member with respect to the developer transport direction. That is, the above-mentioned traveling-wave voltages can be supplied to the transport electrodes in the electrical charge draining area of the first electrical charge draining member and to the transport electrodes located downstream of the electrical charge draining area with respect to the developer transport direction.

By virtue of such a configuration, electrical charge draining of the developer transport surface can be performed efficiently. Further, the developer which electrostatically and strongly adheres to the developer transport surface can be removed smoothly from the developer transport surface without imposing a mechanical load such as friction thereto.

The developer supply apparatus may further comprise a grid electrode interposed between the developer transport surface and the electrical charge draining member. By virtue of such a configuration, electrical charge draining of the developer transport surface can be performed more stably.

The developer supply apparatus may further comprise an electricity supply section for grid which supplies electricity to the grid electrode. In this case, the above-described control section is configured to control the electricity supply section for grid so as to set a potential of the grid electrode to the same polarity as the charging polarity of the developer when electricity is supplied to the transport electrodes while supply of electricity to the electrical charge draining member is stopped.

By virtue of such a configuration, for example, in an image formation period in which an image in the developer is formed on the developer-image carrying surface, the grid electrode is set to a potential whose polarity is the same as the charging polarity of the developer. Thus, undesired lifting of the developer from the developer transport surface can be restrained. Further, adhesion of the developer to the grid electrode can be restrained.

(3) An electric field developer transport apparatus of the present invention is configured to transport a charged developer along a predetermined developer transport direction by means of an electric field. This electric field developer transport apparatus is disposed to face a developer carrying body. The developer carrying body has a developer carrying surface. This developer carrying surface is a surface which can carry a thin layer of the developer and which is formed in parallel with a predetermined main scanning direction. The developer carrying surface can be moved along a predetermined moving direction. The moving direction may be set to be parallel with a sub-scanning direction orthogonal to the main scanning direction.

Specifically, for example, an electrostatic-latent-image carrying body having a latent-image forming surface configured such that an electrostatic latent image in the form of an electric-potential distribution can be formed on the surface can be used as the developer carrying body. Alternatively, for example, a recording medium (paper) transported along the sub-scanning direction can be used as the developer-carrying body. Alternatively, for example, a roller, a sleeve, or a belt-like member (a developing roller, a developing sleeve, or the like) configured and disposed such that it faces the recording medium or the electrostatic-latent-image carrying body and can transfer the developer onto the recording medium or the electrostatic-latent-image carrying body can be used as the developer carrying body.

The electric field developer transport apparatus of the present invention includes a developer transport body and an electrical charge draining member.

The developer transport body has a developer transport surface parallel with the main scanning direction. The developer transport body is disposed such that the developer transport surface faces the developer carrying body.

A plurality of transport electrodes are arrayed along the moving direction. These transport electrodes are provided along the developer transport surface. These transport electrodes are configured and disposed such that, when traveling-wave voltages are applied to the transport electrodes, the transport electrodes can transport the developer in a predetermined developer transport direction.

The electrical charge draining member is disposed such that the electrical charge draining member faces the developer transport surface on the upstream side and/or the downstream side, with respect to the developer transport direction, of a closest proximity position where the distance between the developer carrying surface and the developer transport surface becomes the shortest. The electrical charge draining member is configured so as to be able to restrain charge up on the developer transport surface through aerial discharge.

For example, the electrical charge draining member can be provided to face a facing area of the developer transport surface in which the developer transport surface faces the developer carrying body. Further, a first electrical charge draining member can be provided on the upstream side of the closest proximity position with respect to the developer transport direction, and a second electrical charge draining member can be provided on the downstream side of the closest proximity position with respect to the developer transport direction.

The electric field developer transport apparatus of the present invention having the above-described configuration operates as follows.

Predetermined traveling-wave voltages are applied to the plurality of transport electrodes. Thus, the charged developer moves on the developer transport surface in the developer transport direction. The electrical charge draining member restrains charge up of the developer transport surface on the upstream side and/or downstream side of the closest proximity position with respect to the developer transport direction. For example, during a non-image forming period in which an image in the developer is not formed on the developer carrying surface (specifically, after completion of formation of the image), electrical charge draining of the developer transport surface is performed.

According to such a configuration, transport of the developer on the developer transport surface can be performed smoothly.

The electric field developer transport apparatus may further comprise a grid electrode interposed between the developer transport surface and the electrical charge draining member. By virtue of such a configuration, electrical charge draining of the developer transport surface can be performed more stably.

BEST MODE FOR CARRYING OUT THE INVENTION

A mode for carrying out the present invention (a mode which the applicant contemplated as the best at the time of filing the present application) will next be described with reference to the drawings.

[1]

<Structure>

A process unit which includes a developer transport body according to an embodiment of the present invention will now be described with reference to the drawings. This process unit is applied to a laser printer (image forming apparatus) 10 which carries out monochrome printing and whose schematic side sectional view is shown in FIG. 1.

Figure 1:
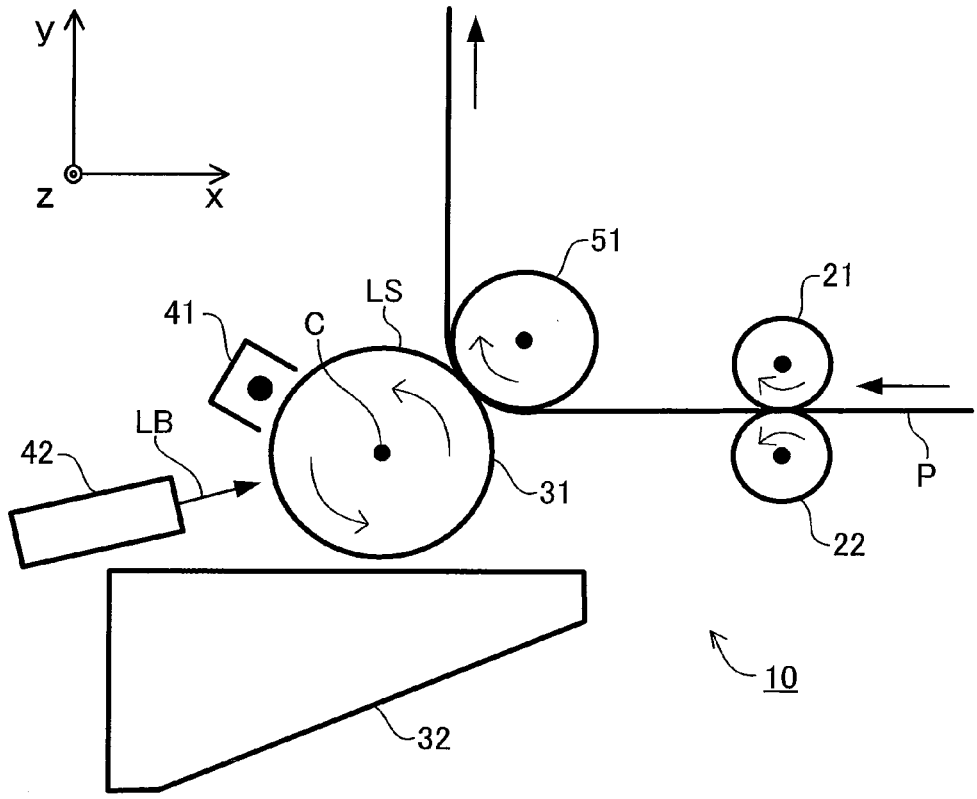
FIG. 1 is a schematic side sectional view of a laser printer to which a developer transport body according to a first embodiment of the present invention is applied.

As shown in FIG. 1, the laser printer 10 includes a pair of resist rollers 21 and 22; a photoconductor drum 31, which serves as a latent-image carrying body; a toner box 32; a charger 41; a scanner unit 42; and a transfer roller 51. Notably, the photoconductor drum 31 and the toner box 32 constitute a process unit. Further, the charger 41 and the scanner unit 42 constitute electrostatic-latent-image forming means.

In the laser printer 10, sheets of paper P are stored in an unillustrated paper feed tray in a stacked state. The laser printer 10 is configured to feed the stored sheets of paper P toward the resist rollers 21 and 22 one sheet at a time. The resist rollers 21 and 22 feed the fed paper P toward a position between the photoconductor drum 31 and the transfer roller 51 at a predetermined timing.

Figure 2:
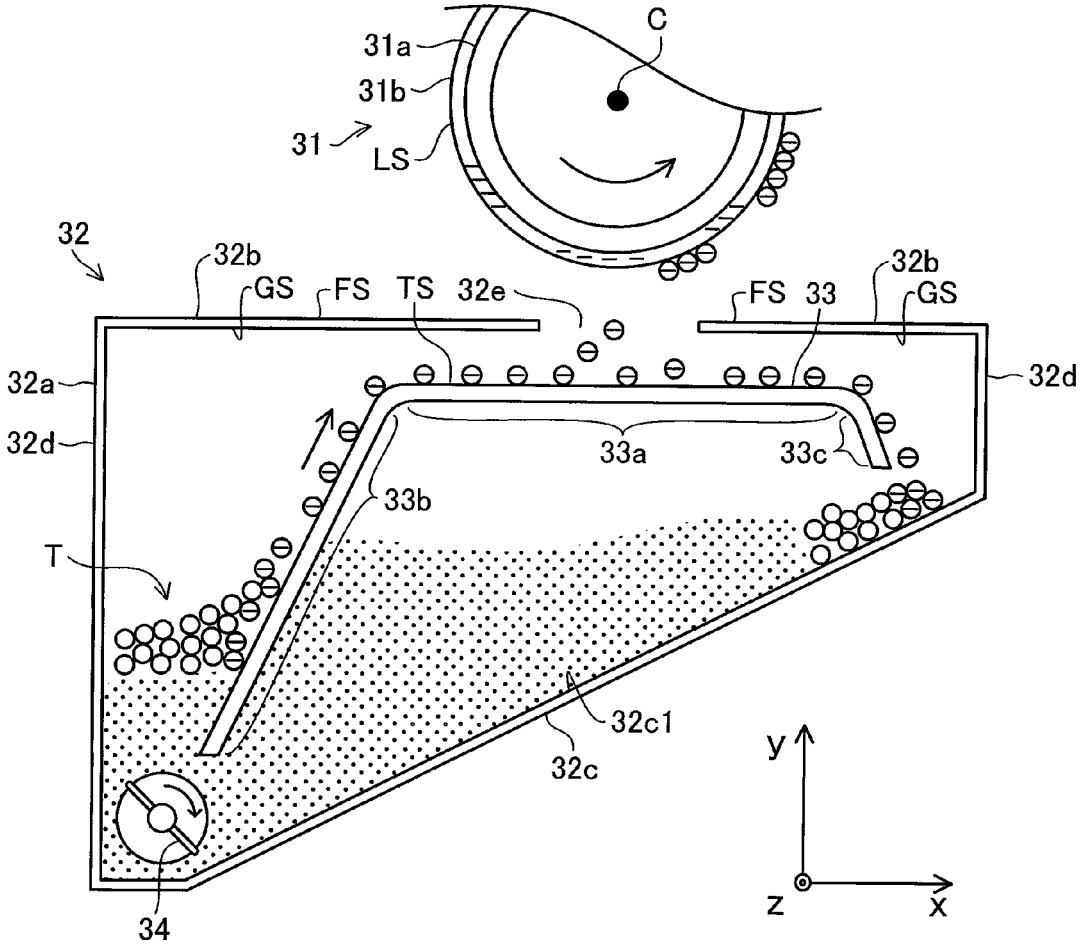
FIG. 2 is a partial enlarged sectional view showing a toner box and a photoconductor drum shown in FIG. 1.

The photoconductor drum 31 is composed of a cylindrical drum body 31*a* whose center axis C is parallel to a Z-axis, and a photoconductive layer 31*b* formed over the circumferential surface (side surface) of the drum body 31*a*, as shown in FIG. 2, which shows a portion of the photoconductor drum 31. The drum body 31*a* is formed of an electrically conductive material (in the present embodiment, metal), and a predetermined bias is applied thereto (in the present embodiment, the drum body 31*a* is grounded so that its potential is 0 V). The photoconductive layer 31*b* is formed of a negatively chargeable photoconductive material (in the present invention, a material which contains polycarbonate as a predominant component). That is, the photoconductive layer 31*b* is charged substantially uniformly to a negative polarity (negatively charged). When the photoconductive layer 31*b* is exposed to light in that state, the absolute value (magnitude) of a charge amount of a portion exposed to light decreases. The photoconductor drum 31 rotates counterclockwise in FIGS. 1 and 2. Notably, a radially outward surface of the photoconductive layer 31*b* is also called a "latent-image forming surface LS" in the present specification.

As shown in FIG. 2 on an enlarged scale, the toner box 32 includes an enclosure 32*a*. A developer transport body 33 and an agitator 34 are provided within the enclosure 32*a*.

The enclosure 32*a* is a box-like member which roughly assumes the form of a rectangular parallelepiped and has a single top plate (hole forming wall) 32*b*, a single bottom plate 32*c*, and four side plates 32*d* (only two of the side plates 32*d* are shown in FIG. 2). The enclosure 32*a* is disposed in such a manner that the top plate 32*b* becomes parallel to a plane (X-Z plane) which includes an X-axis and the Z-axis perpendicular to the X-axis, and the top plate 32*b* face the latent-image forming surface LS.

The top plate 32*b*, which assumes a rectangular shape in its front view, has long sides which have a length approximately equal to that of the photoconductor drum 31 as measured along a Z-axis direction (a direction parallel to the center axis of the photoconductor drum 31) and which are parallel to the Z-axis, and short sides which are parallel to the X-axis. The top plate 32*b* has a developer passage hole 32*e*, which extends through the top plate 32*b* in the direction of a Y-axis orthogonal to the X-axis and the Z-axis. The centers of the short sides of the developer passage hole 32*e* on a plane containing an outside surface (latent-image facing surface which faces the latent-image forming surface LS) FS of the top plate 32*b* coincide with a position on the plane containing the latent-image facing surface FS at which the distance, with respect to the Y-axis direction, between the latent-image forming surface LS and the plane containing the latent-image facing surface FS becomes the shortest.

The bottom plate 32*c* slants in the Y-axis negative direction toward the X-axis negative direction. A black developer T containing polyester as a predominant component (in the present embodiment, non-magnetic one-component polymeric toner) is charged into the enclosure 32*a*.

The developer transport body 33 is a plate-shaped member having a predetermined thickness. The developer transport body 33 is disposed such that a portion of the developer transport body 33 faces the developer passage hole 32*e*. The developer transport body 33 is composed of a central constituent portion 33*a*, an upstream constituent portion 33*b*, and a downstream constituent portion 33*c*.

In its front view, the central constituent portion 33*a* assumes the form of a rectangle whose long sides have a length approximately equal to the length of the photoconductor drum 31 and are parallel to the Z-axis and whose short sides are longer than the diameter of the photoconductor drum 31 and are parallel to the X-axis. The central constituent portion 33*a* is disposed at a position where its center with respect to the X-axis direction coincides with the center of the developer passage hole 32*e* with respect to the X-axis direction, such that the central constituent portion 33*a* becomes parallel to an inside surface (transport body facing surface) GS of the top plate 32*b* and faces the transport body facing surface GS. Thus, a portion of the central constituent portion 33*a* faces the developer passage hole 32*e*.

The upstream constituent portion 33*b* extends in the X-axis negative direction from an end portion of the central constituent portion 33*a* located on the side toward the X-axis negative direction. The upstream constituent portion 33*b* slants in a Y-axis negative direction toward the X-axis negative direction. An end portion of the upstream constituent portion 33*b* located on the side toward the X-axis negative direction extends to a position which is located near an inside surface 32*c*1 of the bottom plate 32*c* of the enclosure 32*a* (the bottom plate upper surface 32*c*1 of the toner box 32) and near the side plate 32*d* of the enclosure 32*a* located on the side toward the X-axis negative direction (that is, the vicinity of a deepest portion of the enclosure 32*a*). By virtue of this configuration, even when the amount of the developer T becomes slight, the end portion of the upstream constituent portion 33*b* located on the side toward the X-axis negative direction is buried in the developer T.

The downstream constituent portion 33*c* extends in the X-axis positive direction from an end portion of the central constituent portion 33*a* located on the side toward the X-axis positive direction. The downstream constituent portion 33*c* slants in the Y-axis negative direction toward the X-axis positive direction. An end portion of the downstream constituent portion 33*c* located on the side toward the X-axis positive direction extends to a position which is located near the bottom plate upper surface 32*c*1 of the toner box 32 and near the side plate 32*d* of the enclosure 32*a* located on the side toward the X-axis positive direction (that is, near a shallowest portion of the enclosure 32*a*).

Figure 3:
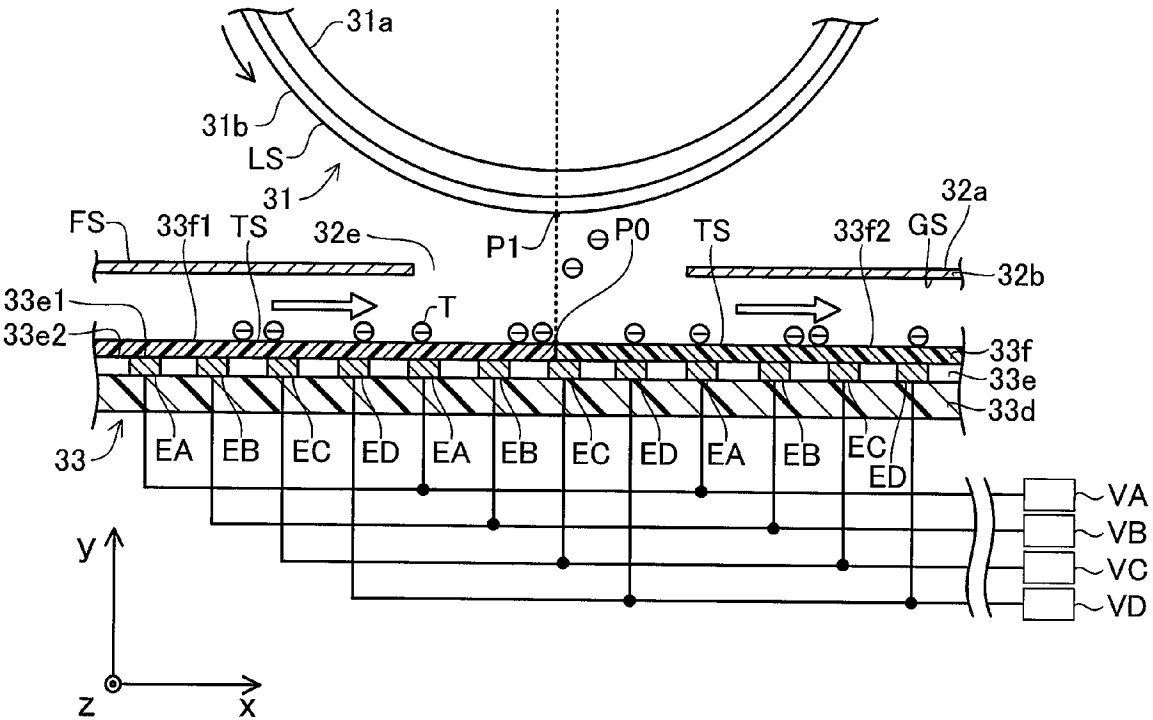
FIG. 3 is an enlarged sectional view of portions of the toner box and the photoconductor drum shown in FIG. 2, the portions being located in the vicinity of a closest proximity position.

As shown in FIG. 3, which shows a portion of the developer transport body 33 on an enlarged scale, the developer transport body 33 has a three-layer structure; i.e., is composed of three layers each having a predetermined thickness. That is, the developer transport body 33 includes a base plate 33*d*, which constitutes a layer (bottom layer) most distant from the latent-image forming surface LS; an electrode forming layer 33*e*, which constitutes a layer (intermediate layer) second most distant from the latent-image forming surface LS; and a surface film 33*f*, which constitutes a layer (top layer) closest to the latent-image forming surface LS.

The base plate 33*d* is formed of an electrically insulative material (in the present embodiment, an electrically insulative resin).

The electrode forming layer 33*e* is composed of a plurality of electrodes 33*e*1 (or EA, EB, EC, and ED), which partially constitute transport-electric-field forming means, and an inter-electrode insulator 33*e*2.

The plurality of electrodes 33*e*1 are formed of an electrically conductive material (in the present embodiment, metal). Each electrode 33*e*1 roughly assumes the form of a rectangular parallelepiped. That is, each electrode 33*e*1 has a predetermined height, and assumes a rectangular shape in its plan view; i.e., has long sides parallel to the Z-axis and short sides extending in a base plate surface direction which is perpendicular to the Z-axis and extends along a surface of the base plate 33*d* on the side toward the latent-image forming surface LS (X-axis direction in the case of the center constituent portion 33*a* shown in FIG. 3). The electrodes 33*e*1 are arrayed at constant intervals in the base plate surface direction on the surface of the base plate 33*d* on the side toward the latent-image forming surface LS.

Power circuits VA to VD are sequentially and repeatedly connected to the respective electrodes 33*e*1 arranged in the X-axis positive direction. That is, the power circuit VB is connected to the electrode 33*e*1 (electrode EB) which is located adjacent, in the X-axis positive direction, to the electrode 33*e*1 (electrode EA) to which the power circuit VA is connected. The power circuit VC is connected to the electrode 33*e*1 (electrode EC) which is located adjacent to the electrode EB in the X-axis positive direction. The power circuit VD is connected to the electrode 33e1 (electrode ED) which is located adjacent to the electrode EC in the X-axis positive direction. The power circuit VA is connected to the electrode 33e1 (electrode EA) which is located adjacent to the electrode ED in the X-axis positive direction.

The inter-electrode insulator 33e2 is formed of an electrically insulative material (in the present embodiment, an electrically insulative resin). The inter-electrode insulator 33e2 is charged into a space between two electrodes 33e1 located adjacent to each other. The upper surface of the inter-electrode insulator 33e2 is flush with the upper surfaces of the electrodes 33e1. By virtue of such a configuration, the inter-electrode insulator 33e2 prevents formation of a short circuit between the adjacent electrodes 33e1.

The surface film 33f is formed on the surface of the electrode forming layer (intermediate layer) 33e (the electrodes 33e1 and the inter-electrode insulator 33e2) on the side toward the latent-image forming surface LS, through application of a material of the surface film 33f onto the surface. Notably, a portion of a transport surface TS, which is the surface of the surface film 33f on the side toward the latent-image forming surface LS, the portion facing the developer passage opening 32e, also faces the latent-image forming surface LS.

The surface film 33f is composed of an upstream surface film 33f1, which serves as a first constituent surface, and a downstream surface film 33f2, which serves as a second constituent surface.

The upstream surface film 33f1 constitutes a portion extending from an end portion of the developer transport body 33 located on the upstream side with respect to a developer transport direction (on the side toward the X-axis negative direction) to a closest proximity position P0 on the transport surface TS where the distance between the latent-image forming surface LS and the transport surface TS (with respect to the Y-axis direction) becomes the shortest.

The developer transport direction refers to a direction which is parallel to the surface of the surface film 33f on the side toward the latent-image forming surface LS and is directed from one end portion of the surface film 33f on the side toward the X-axis negative direction to the other end portion thereof on the side toward the X-axis positive direction.

Figure 4:
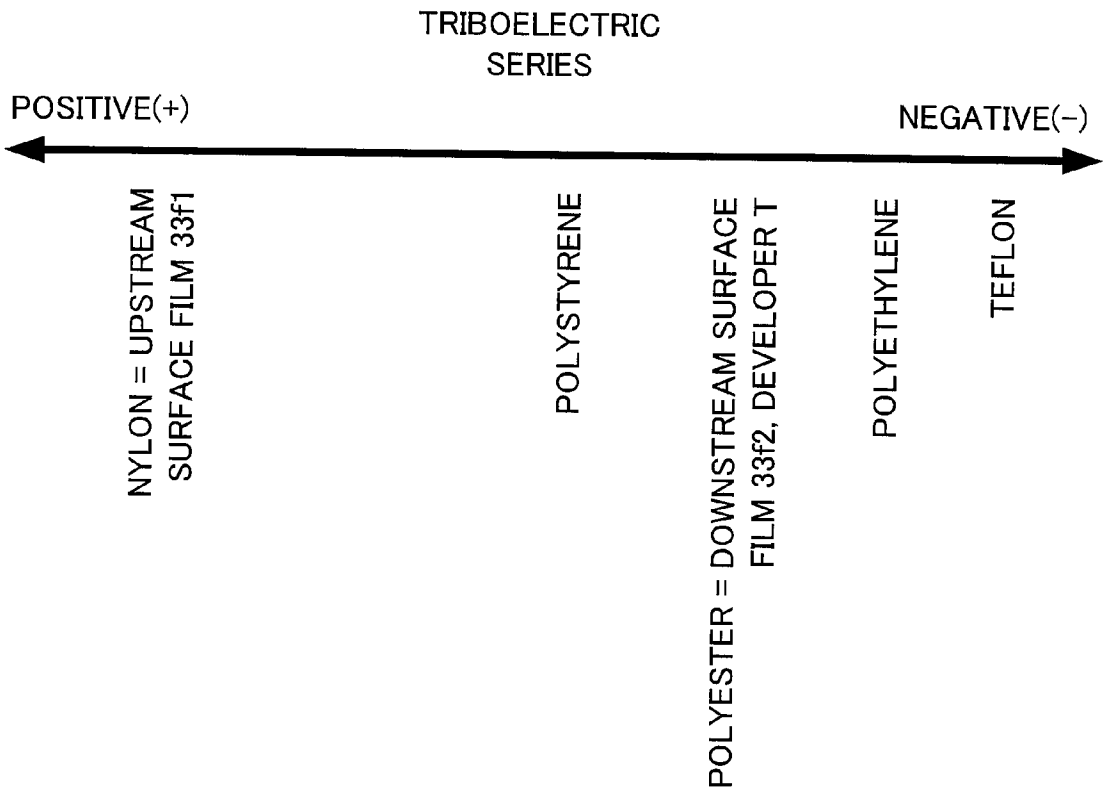
FIG. 4 is a diagram showing a triboelectric series.

The upstream surface film 33f1 is formed of a material which charges the developer T to the negative polarity (negatively charges the developer) by means of friction (contact) between the upstream surface film 33f1 and the developer T such that the absolute value of the charge amount of the developer T becomes relatively large (charges the developer T relatively strongly to the negative polarity by means of friction between the upstream surface film 33f1 and the developer T). In the present embodiment, the upstream surface film 33f1 is formed of nylon, which is located on the positive side of polyester, which is the predominant component of the developer T, in the triboelectric series shown in FIG. 4. In the triboelectric series, one of two substances of different types which is charged to a positive polarity (+) due to friction between the two substances is located on the positive side; and the other substance which is charged to a negative polarity (−) due to the friction is located on the negative side.

The downstream surface film 33f2 constitutes a portion extending from the closest proximity position P0 to an end portion of the developer transport body 33 located on the downstream side with respect to the developer transport direction (on the side toward the X-axis positive direction). That is, the downstream surface film 33f2 is disposed in an adjacent area which is an area located downstream of the upstream surface film 33f1 with respect to the developer transport direction and adjacent to the upstream surface film 33f1.

The downstream surface film 33f2 is formed of a material which lowers the absolute value of the charge amount of the developer T in the adjacent area, as compared with an assumed case in which the upstream surface film 33f1 is disposed in the adjacent area. In the present embodiment, the downstream surface film 33f2 is formed of polyester, which is the predominant component of the developer T.

Through formation of the upstream surface film 33f1 and the downstream surface film 33f2 on the surface of the electrode forming layer 33e (the electrodes 33e1 and the inter-electrode insulator 33e2) on the side toward the latent-image forming surface LS, there can be readily formed the transport surface TS which varies, in terms of the degree to which the developer T is charged (charging characteristic), in accordance with the position on a single member (the substrate composed of the base plate 33d, the inter-electrode insulator 33e2, and the surface film 33f).

Referring back to FIG. 2, the agitator 34 is disposed at a position which is located near the end portion of the developer transport body 33 on the side toward the X-axis negative direction and near the bottom plate upper surface 32c1 of the toner box 32. The agitator 34 agitates and fluidizes the developer T to thereby cause the developer T to come into friction engagement with the upstream surface film 33f1 of the upstream constituent portion 33b.

Referring back to FIG. 1, the charger 41 is disposed such a manner as to face the latent-image forming surface LS. The charger 41 is connected to an unillustrated bias circuit. The charger 41 is a charger for negative charge (in the present embodiment, a scorotron-type charger) which uniformly and negatively charges the latent-image forming surface LS when a bias is applied thereto.

The scanner unit 42 includes an unillustrated laser emission section which generate a laser beam LB on the basis of image data. The scanner unit 42 projects the generated laser beam LB to a position on the latent-image forming surface LS, the position being located downstream of the charger 41 and upstream of the toner box 32 with respect to the rotational direction of the photoconductor drum 31 (counterclockwise direction in FIG. 1), whereby the latent-image forming surface LS is exposed to light. The scanner 42 is configured to move (sweep), along a predetermined sweep direction approximately parallel to the Z-axis, the position on the latent-image forming surface LS at which the laser beam LB is focused.

The transfer roller 51 rotates clockwise in FIG. 1. A circumferential surface of the transfer roller 51 is disposed to come into contact with the latent-image forming surface LS of the photoconductor drum 31. The transfer roller 51 is connected to an unillustrated bias circuit. Upon application of a bias thereto, the transfer roller 51 transfers the developer T from the latent-image forming surface LS to the surface of the paper P which is nipped between the circumferential surface of the transfer roller 51 and the latent-image forming surface LS. Notably, the transfer roller 51 constitutes a portion of the image forming means.

Moreover, the laser printer 10 includes an unillustrated fixing section, a paper ejection section, and a control section.

The fixing section presses the sheet P, onto which the developer T has been transferred, while heating the same, to thereby fix the developer T onto the paper P. Notably, the fixing section constitutes a portion of the image forming means.

The paper ejection section includes a catch tray, and is configured to transport the paper P having passed through the fixing section toward the catch tray, and hold the transported paper P in the catch tray.

The control section is electrically connected to various motors, actuators, sensors, etc. for driving respective movable portions of the laser printer 10, the laser generation section provided in the scanner unit 42, various bias circuits, and various power circuits, and is configured to output command signals thereto at predetermined timings.

<Operation>

Next, operation of the laser printer 10 configured as described above will be described from a point in time at which a user sends a print command signal (containing image data) to the laser printer 10.

Upon receipt of the print command signal, the control section controls the photoconductor drum 31 and the transfer roller 51 to a state in which they rotate (rotating state). Further, the control section controls the charger 41 to a state in which a predetermined charge bias (in the present embodiment, −5000 V) is applied thereto (biased state). As a result, a portion of the latent-image forming surface LS (circumferential surface of the photoconductor drum 31) facing the charger 41 is charged to the negative polarity (negatively charged). As a result of rotation of the photoconductor drum 31, a portion of the latent-image forming surface LS located downstream of the charger 41 with respect to the rotational direction of the photoconductor drum 31 (counterclockwise direction in FIG. 1) is uniformly and negatively charged. That is, the latent-image forming surface LS assumes a predetermined negative reference potential (in the present embodiment, −1000 V) at all positions within that portion. In addition, the control section controls the transfer roller 51 to a state in which a predetermined transfer bias (in the present embodiment, +5000 V) is applied thereto (biased state).

Further, the control section controls the agitator 34 to a state in which it rotates (rotating state). As a result, the developer T comes into friction engagement with the upstream surface film **33*f*1 of the upstream constituent portion 33*b*, whereby the developer T is charged to the negative polarity. Since the end portion (the upstream constituent portion 33*b*) of the developer transport body 33 located on the upstream side with respect to the developer transport direction (the side toward the X-axis negative direction) is buried in the developer T as described above, the developer T stored on the bottom plate upper surface 32*c*1 of the toner box 32** is always supplied onto the transport surface TS.

Figure 5:
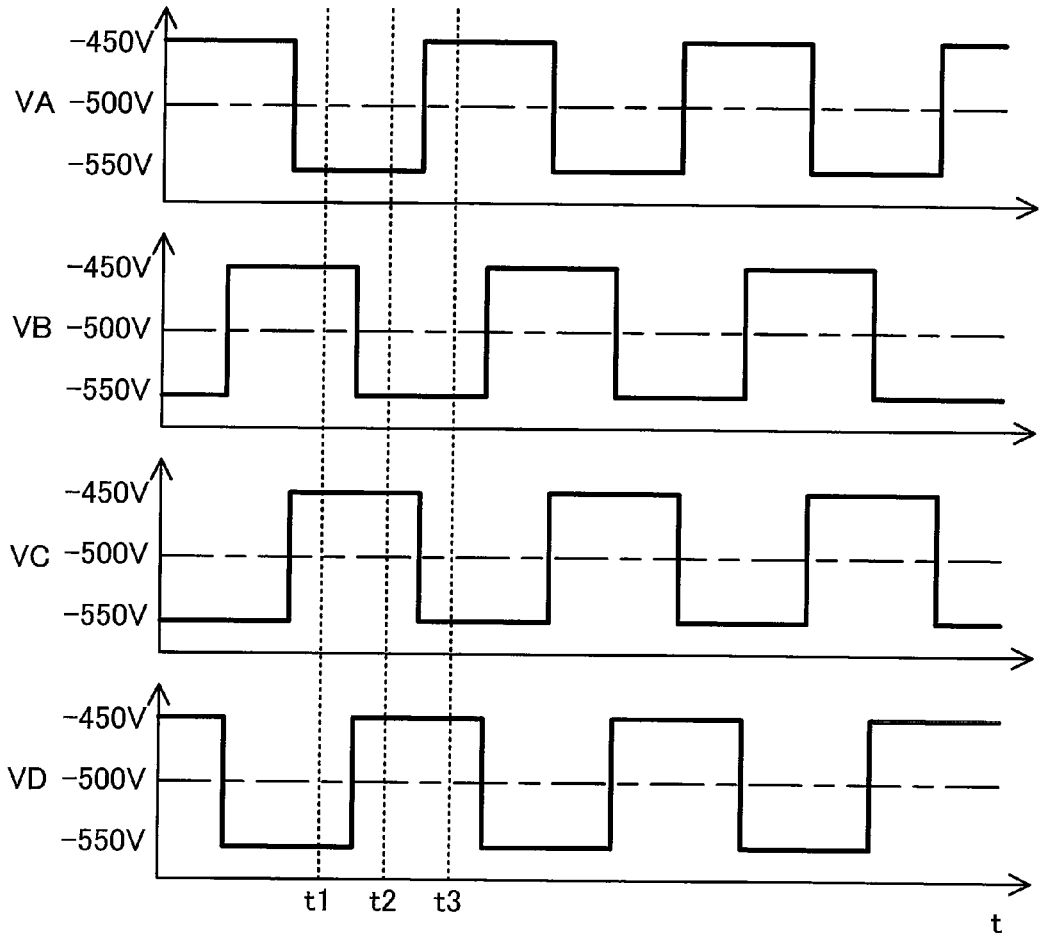
FIG. 5 is a set of graphs showing waveforms of voltages generated by power circuits connected to electrodes shown in FIG. 3.

Moreover, the control section supplies electrical power to the power circuits VA to VD connected to the electrodes **33*e*1 of the developer transport body 33. As shown in FIG. 5**, each of the power circuits VA to VD generates a voltage which has a rectangular waveform of a fixed period and whose average is a predetermined negative value (in the present embodiment, −500 V). The waveforms of the voltages generated by the power circuits VA to VD shift 90° in phase from one another. That is, a phase delay of 90° is produced successively in the power circuits VA to VD in this sequence. Notably, the voltages generated in the power circuits VA to VD constitute a portion of the transport-electric-field forming means.

Figure 6:
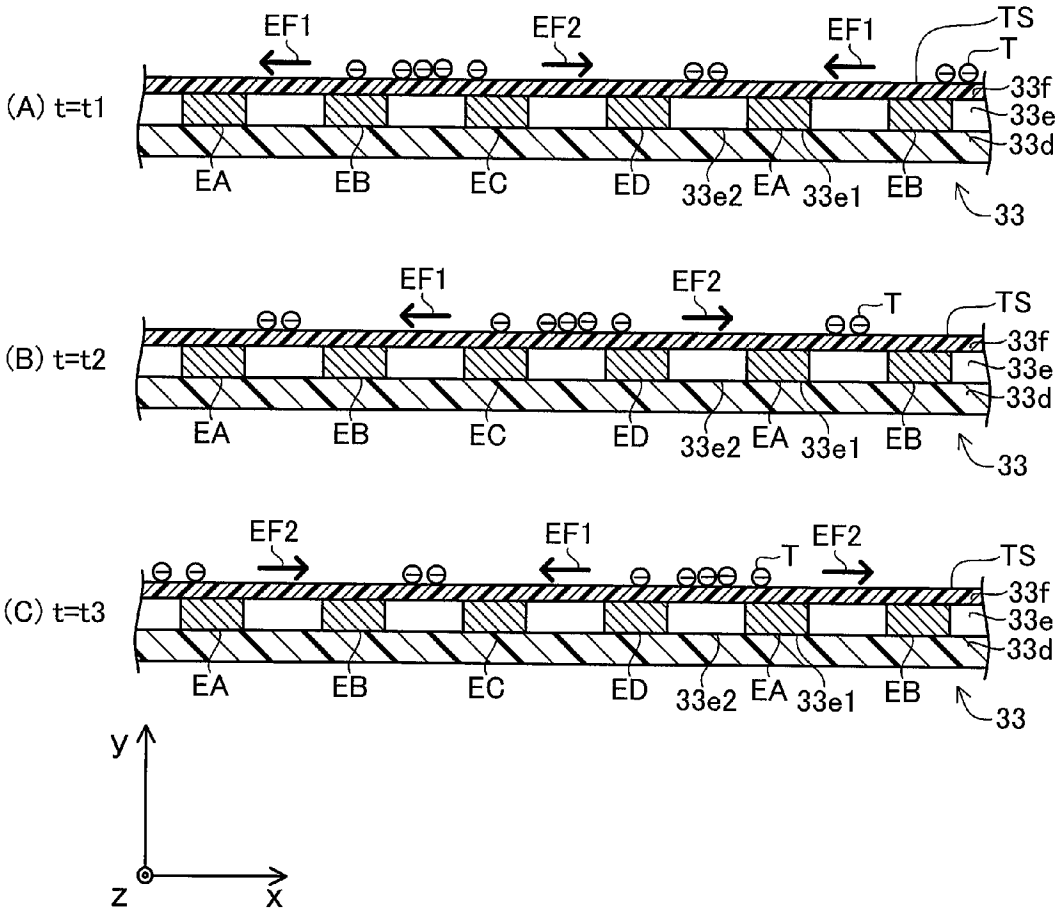
FIG. 6 is a set of explanatory views showing changes, with time, of electric fields formed on a developer transport body shown in FIG. 3.

As a result, for example, at time t1, the electrodes EA are lower in potential than the electrodes EB as shown in section (A) of FIG. 6, and an electric field EF1 whose direction (X-axis negative direction) is opposite the developer transport direction is formed in a space on the transport surface TS between each electrode EA and the corresponding electrode EB. Thus, the negatively charged developer T located within that space receives an electrostatic force acting in the developer transport direction (X-axis positive direction), whereby the developer T is moved in the developer transport direction.

Further, since the electrodes EB and the electrodes EC are equal in potential, relatively weak electric fields are formed within a space on the transport surface TS between each electrode EB and the corresponding electrode EC. That is, both the electric field whose direction is the same as the developer transport direction and the electric field whose direction is opposite the developer transport direction (i.e., the electric fields along the developer advance/retreat direction; that is, the X-axis direction) are relatively weak within that space. Therefore, the developer T located within that space hardly receives electrostatic forces acting along the developer advance/retreat direction.

Further, since the electrodes EC are higher in potential than the electrodes ED, an electric field EF2 whose direction (X-axis positive direction) is the same as the developer transport direction is formed within a space on the transport surface TS between each electrode EC and the corresponding electrode ED. Thus, the negatively charged developer T located within that space receives an electrostatic force acting in the direction (X-axis negative direction) opposite the developer transport direction, whereby the developer T is moved in the direction opposite the developer transport direction.

Moreover, since the electrodes ED and the electrodes EA are equal in potential, electric fields along the developer advance/retreat direction which are formed within a space on the transport surface TS between each electrode ED and the corresponding electrode EA are relatively weak. Therefore, the developer T located within that space hardly receives electrostatic forces acting along the developer advance/retreat direction.

With the above-described operation, at time t1, the negatively charged developer T is collected in spaces on the transport surface TS between the electrodes EB and the electrodes EC.

Similarly, at time t2, the negatively charged developer T is collected in spaces on the transport surface TS between the electrodes EC and the electrodes ED, as shown in section (B) of FIG. 6.

Further, at time t3, the negatively charged developer T is collected in spaces on the transport surface TS between the electrodes ED and the electrodes EA, as shown in section (C) of FIG. 6.

As described above, the regions where the negatively charged developer T is collected move in the developer transport direction (X-axis positive direction) along the transport surface TS with elapse of time. Accordingly, the negatively charged developer T is moved in the developer transport direction with elapse of time.

In the above-described manner, negatively charged portions of the developer T supplied onto the transport surface TS are transported on the transport surface TS from an end portion (predetermined upstream area) of the transport surface TS located on the side toward the direction opposite the developer transport direction (toward the X-axis negative direction) to an end portion (predetermined downstream area) of the transport surface TS located on the side toward the developer transport direction (toward the X-axis positive direction).

As described above, the upstream surface film **33*f*1—which constitutes a portion of the surface film 33*f* extending to the closest proximity position P0 from an upstream end portion of the developer transport body 33 with respect to the developer transport direction—is formed of a material which relatively strongly charges the developer T to the negative polarity through friction between the upstream surface film 33*f*1 and the developer T. Accordingly, while the developer T is transported on the transport surface TS from the above-mentioned end portion to the closest proximity position P0, the developer T is relatively strongly charged to the negative polarity. As a result, the absolute value of the charge amount of the developer T in the vicinity of the closest proximity position P0** becomes relatively large.

Incidentally, at a point in time immediately after the control section has received the print command signal, the latent-image forming surface LS assumes the reference potential (−1000 V) at every position. Meanwhile, the electrodes **33*e*1 assume a potential (−550 V to −450 V) higher than the reference potential. Therefore, between the electrodes 33*e*1 and the latent-image forming surface LS, electric fields directed from the electrodes 33*e*1** toward the latent-image forming surface LS are formed for all positions within the latent-image forming surface LS. As a result, the negatively charged developer T receives electrostatic forces directed from the latent-image forming surface LS toward the transport surface TS. As a result, the developer T moves on the transport surface TS without moving toward the latent-image forming surface LS.

Moreover, as described above, the downstream surface film **33*f*2—which constitutes a portion of the surface film 33*f* extending from the closest proximity position P0 to a downstream end portion of the developer transport body 33 with respect to the developer transport direction—is formed of a material which is the same as the predominant component of the developer T. Accordingly, after the developer T has passed through the closest proximity position P0, the absolute value of the charge amount of the developer T does not increase due to friction between the developer T and the downstream surface film 33*f*2. That is, after the developer T has passed through the closest proximity position P0, the absolute value of the charge amount decreases, as compared with an assumed case where the upstream surface film 33*f*1 is disposed in place of the downstream surface film 33*f*2**. AS a result, adhesion of the developer T to the transport surface TS and aggregation of the developer T can be restrained, whereby the developer T on the transport surface TS can be transported more smoothly than in the assumed case.

When the developer T reaches the downstream end portion of the transport surface TS with respect to the transport direction, the developer T is returned from that end portion onto the bottom plate upper surface **32*c*1 of the toner box 32**.

In such a state, the control section causes the scanner unit 42 to output the laser beam LB on the basis of image data at a predetermined timing. The output laser beam LB is focused on the latent-image forming surface LS at positions corresponding to the image data. Thus, the latent-image forming surface LS is exposed to light at the positions at which the laser beam LB is focused, so that the absolute value of the charge amount decreases at these positions. As a result, at the positions where the latent-image forming surface LS is exposed to light, the potential of the latent-image forming surface LS increases to a potential (in the present embodiment, −100 V), which is closer to the potential (0 V) of the drum body **31*a*** than that of the reference potential (−1000 V). In this manner, an electrostatic latent image is formed on the latent-image forming surface LS by means of the potential of the latent-image forming surface LS.

Figure 7:
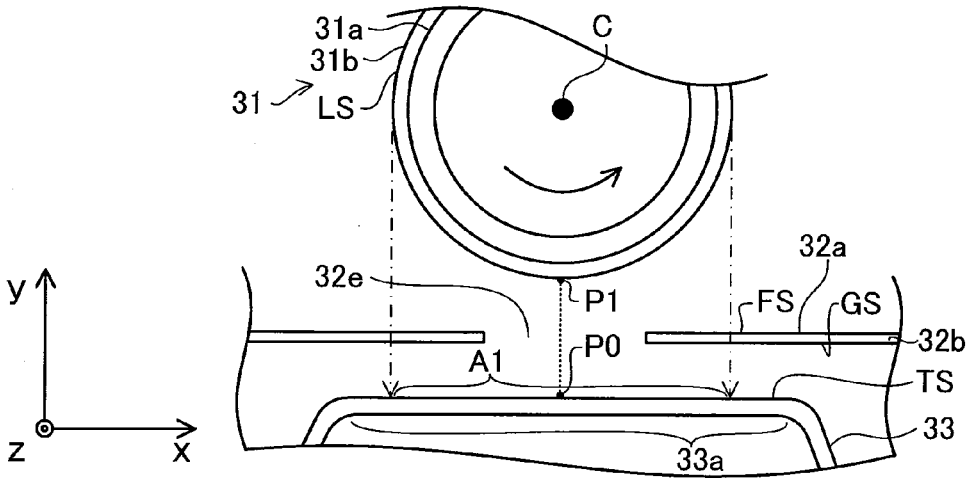
FIG. 7 is an explanatory view showing a projection area formed on a transport surface through projection of the photoconductor drum onto the transport surface in a predetermined projection direction.

As shown in FIG. 7, in a projection area A1—which is formed on the transport surface TS by means of projecting the photoconductor drum 31 onto the transport surface TS in a projection direction (Y-axis direction) parallel to a line which passes through a position P1 on the latent-image forming surface LS where the distance between the transport surface TS and the latent-image forming surface LS becomes the shortest, and the closest proximity position P0—the distance between the transport surface TS and the latent-image forming surface LS becomes relatively short. In particular, at the closest proximity position P0, the distance between the transport surface TS and the latent-image forming surface LS becomes the shortest.

Further, in the case where the developer transport body 33 is accommodated within the enclosure **32*a* as in the present embodiment, in a developer-passage-hole facing area A2 (shown in FIG. 8), which is a portion of the projection area A1 and in which the transport surface TS faces the developer passage hole 32*e*, the top plate (hole forming wall) 32*b* of the enclosure 32*a*** does not prevent movement of the developer T when the developer T moves from the transport surface TS toward the latent-image forming surface LS.

According, when as a result of rotation of the photoconductor drum 31 the formed electrostatic latent image faces the developer passage hole **32*e* formed in the latent-image facing surface FS (top plate 32*b*), the intensities of electric fields directed from the latent-image forming surface LS toward the electrodes 33*e*1 (i.e., the transport surface TS) become relatively large (the electric fields become relatively strong) for portions of the electrostatic latent images corresponding to the positions where the latent-image forming surface LS is exposed to light by means of the laser beam LB. Further, the top plate 32*b* does not prevent movement of the developer T from the transport surface TS toward the latent-image forming surface LS. As a result, the developer T is moved from the transport surface TS toward the latent-image forming surface LS by means of an electrostatic force which is produced through interaction between the electric fields and the charge (charge amount) of the developer T, whereby the developer T passes through the developer passage hole 32*e***, and reaches the latent-image forming surface LS. That is, the developer T is supplied onto the latent-image forming surface LS.

The developer T having reached the latent-image forming surface LS adheres only to portions of the latent-image forming surface LS having been exposed to light by means of the laser beam LB. In this manner, the electrostatic latent image formed on the latent-image forming surface LS is developed by the developer T, whereby an image in the developer T is formed on the latent-image forming surface LS.

Further, as described above, the downstream end portion of the upstream surface film **33*f*1 with respect to the developer transport direction is located at the closest proximity position P0. Accordingly, the absolute value of the charge amount of the developer T having been transported on the transport surface TS and reached the vicinity of the closest proximity position P0** is sufficiently large. Thus, the developer T can be moved in the direction of the electrostatic force irrespective of forces other than the electrostatic force (disturbing forces). Accordingly, the developer T can be caused to adhere to proper portions of the latent-image forming surface LS corresponding to the electrostatic latent image. That is, the quality of an image formed on the latent-image forming surface LS by use of the developer T can be improved.

Further, the control section controls the resist rollers 21 and 22 so as to transport the paper P toward a position between the photoconductor drum 31 and the transfer roller 51 at a predetermined timing such that the position of the image formed on the latent-image forming surface LS by use of the developer T coincides with a position on the paper P to which the image is to be transferred.

When the paper P reaches a transfer position (position where the latent-image forming surface LS and the circumferential surface of the transfer roller 51 come into contact with each other) (when the paper P is nipped between the latent-image forming surface LS of the photoconductor drum 31 and the circumferential surface of the transfer roller 51), the developer T having adhered to the latent-image forming surface LS moves onto the paper P and adheres to the paper P at the transfer position. In this manner, the image in the developer T formed on the latent-image forming surface LS through development is transferred onto the paper P.

Subsequently, when the paper P reaches the fixing section, the developer T transferred onto the paper P is heated under pressure. As a result, the developer T transferred onto the paper P is fixed to the paper P.

When the paper P is further transferred so that the paper P reaches the paper ejection section, the paper P is ejected onto the catch tray.

After completion of ejection of the paper P, the control section stops the rotations of the photoconductor drum 31, the agitator 34, and the transfer roller 51, which have each been controlled to the rotating state. Further, the control section controls the charger 41 and the transfer roller 51, each of which has been controlled to the biased state, to a state where no bias is applied (unbiased state).

In this manner, the laser printer 10 forms on the paper P (prints on the paper P) an image represented by the image date contained in the print command signal submitted by the user.

As described above, according to the embodiment of the developer transport body of the present invention, the absolute value of the charge amount of the developer T can be rendered relatively large in an area (first area) in which the upstream surface film 33/1 (first constituent surface) is disposed. Accordingly, the developer T can be moved in the direction of the electrostatic force irrespective of forces other than the electrostatic force (disturbing forces), so that the developer T can be caused to adhere to proper portions of the latent-image forming surface LS corresponding to the electrostatic latent image. That is, the quality of an image formed on the latent-image forming surface LS by use of the developer T can be improved.

Meanwhile, in an area (second area) in which the downstream surface film 33/2 (second constituent surface) is disposed, the absolute value of the charge amount of the developer T becomes small, as compared with an assumed case where the upstream surface film 33/1 is disposed in the second area. As a result, in the second area, adhesion of the developer T to the transport surface TS and aggregation of the developer T can be restrained, so that the developer T on the transport surface TS can be transported smoothly.

As described above, according to the present developer transport body, the quality of an image in the developer T formed on the latent-image forming surface LS in accordance with the electrostatic latent image can be improved. Moreover, the quality of an image formed on the paper P (recording medium) through transfer of the image from the latent-image forming surface LS to the paper P can be improved.

In addition, according to the above-described embodiment, the downstream end portion of the upstream surface film 33/1 with respect to the developer transport direction is located at the closest proximity position P0. This configuration increases, without fail, the absolute value of the charge amount of the developer T in an area in which an electric field produced due to a difference (potential difference) between the potential of the latent-image forming surface LS and that of the transport surface TS becomes relatively strong as a result of the distance between the latent-image forming surface LS and the transport surface TS becoming short. As a result, the quality of an image formed on the latent-image forming surface LS by use of the developer T can be improved more reliably.

Notably, the present invention is not limited to the above-described embodiment, and various modifications can be employed within the scope of the present invention. For example, the developer transport body of the above-described embodiment may be applied to a laser printer which includes a plurality of sets each including a process unit and a scanner unit and which can perform color printing.

Further, the above-described embodiment is configured such that the end portion of the upstream surface film 33/1 located on the downstream side with respect to the developer transport direction (on the side toward the X-axis positive direction) is located at the closest proximity position P0. However, the above-described embodiment may be configured such that the downstream end portion of the upstream surface film 33/1 is located on the upstream side or downstream side of the closest proximity position P0, so long as the downstream end portion is located within a predetermined area containing the closest proximity position P0.

For example, the predetermined area in which the downstream end portion of the upstream surface film 33/1 with respect to the developer transport direction is located is desirably an area in which the developer T leaves the transport surface TS so as to move toward the latent-image forming surface LS. In this case, the absolute value of the charge amount of the developer T which is moved toward the latent-image forming surface LS can be more reliably rendered larger. In addition, on the downstream side of that area, the developer T can be smoothly transported without fail. As a result, the quality of an image formed on the latent-image forming surface LS by use of the developer T can be improved more reliably.

Figure 8:
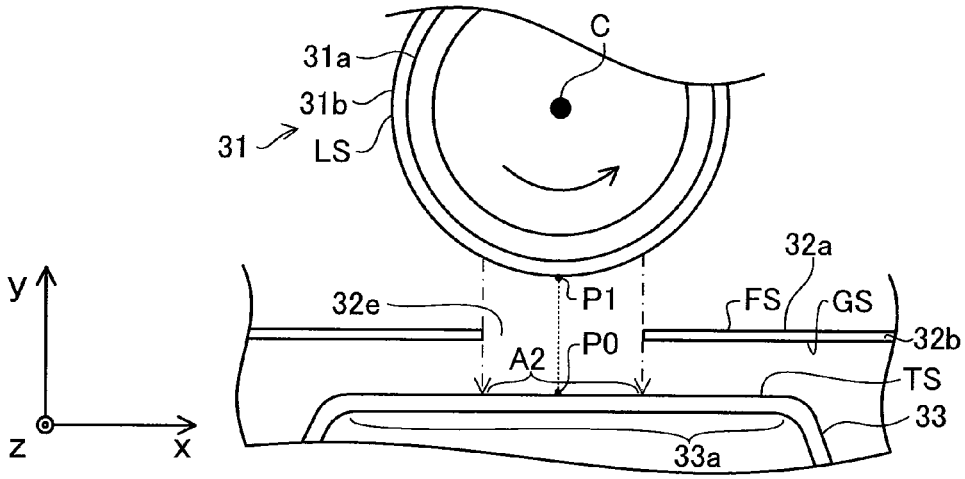
FIG. 8 is an explanatory view showing a developer-passage-hole facing area of the projection area shown in FIG. 7, the developer-passage-hole facing area being an area in which the transport surface faces a developer passage hole.

Further, the predetermined area is desirably the projection area A1 shown in FIG. 7 or the developer-passage-hole facing area A2 shown in FIG. 8. As described above, in the projection area A1, the electric field for moving the developer T from the transport surface TS toward the latent-image forming surface LS becomes strong. Further, in the developer-passage-hole facing area A2, the electric field for moving the developer T from the transport surface TS toward the latent-image forming surface LS becomes stronger, and movement of the developer T from the transport surface TS toward the latent-image forming surface LS is not prevented. Accordingly, these areas approximately correspond to the area in which the developer T leaves the transport surface TS so as to move toward the latent-image forming surface LS. Accordingly, in this case as well, the absolute value of the charge amount of the developer T which is moved toward the latent-image forming surface LS can be more reliably rendered larger. In addition, on the downstream side of that area, the developer T can be smoothly transported without fail. As a result, the quality of an image formed on the latent-image forming surface LS by use of the developer T can be improved more reliably.

In the above-described embodiment, the transport surface TS is formed by two types of surface films (the upstream surface film 33/1 and the downstream surface film 33/2) whose materials differ from each other. However, the transport surface TS may be formed by three or more types of surface films whose materials differ from one another.

Figure 9:
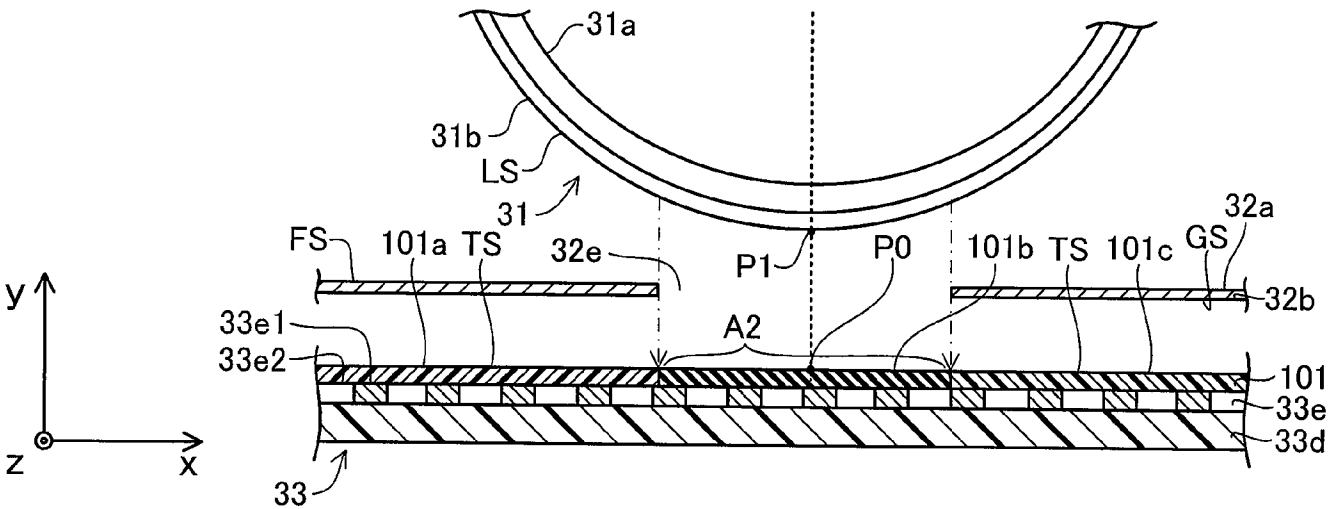
FIG. 9 is an enlarged sectional view of portions of a toner box and a photoconductor drum according to a modification of the first embodiment of the present invention, the portions being located in the vicinity of the closest proximity position.

In this case, for example, as shown in FIG. 9, the developer transport body 33 includes a surface film 101 in place of the surface film 33*f*. The surface film 101 is composed of an upstream surface film 101*a*, which constitutes a portion extending from the upstream end portion of the developer transport body 33 with respect to the developer transport body 33 to the most upstream position in the developer-passage-hole facing area A2 (area where the transport surface TS faces the developer passage hole 32*e*); a center surface film 101*b*, which constitutes a portion extending from the most upstream position in the developer-passage-hole facing area A2 to the most downstream position in the developer-passage-hole facing area A2; and a downstream surface film 101*c*, which constitutes a portion extending from the most downstream position in the developer-passage-hole facing area A2 to the downstream end portion of the developer transport body 33 with respect to the developer transport.

The upstream surface film 101*a* is formed of a material which charges the developer T through contact with the developer T. The center surface film 101*b* is formed of a material which renders the absolute value of the charge amount of the developer T in the corresponding area smaller than that in an assumed case in which the upstream surface film 101*a* is disposed in the corresponding area. The downstream surface film 101*c* is formed of a material which renders the absolute value of the charge amount of the developer T in the corresponding area smaller than that in an assumed case in which the center surface film 101*b* is disposed in the corresponding area. In this case, it can be said that the upstream surface film 101*a* constitutes the first constituent surface and the center surface film 101*b* constitutes the second constituent surface, or that the center surface film 101*b* constitutes the first constituent surface and the downstream surface film 101*c* constitutes the second constituent surface.

Notably, the center surface film 101*b* may be formed of a material which renders the absolute value of the charge amount of the developer T in the corresponding area larger than that in the assumed case in which the upstream surface film 101*a* is disposed in the corresponding area. In this case, it can be said that the center surface film 101*b* constitutes the first constituent surface and the downstream surface film 101*c* constitutes the second constituent surface.

Further, in the above-described embodiment, the downstream surface film 33*f*2 is formed of a material which is the same as the predominant component of the developer T. However, the downstream surface film 33*f*2 may be formed of a material which negatively charges the developer T through friction between the downstream surface film 33*f*2 and the developer T such that the absolute value of the charge amount of the developer T becomes smaller than that in the assumed case in which the upstream surface film 33*f*1 is disposed in place of the downstream surface film 33*f*2 (negatively charges the developer T more weakly than does the upstream surface film 33*f*1, through friction between the downstream surface film 33*f*2 and the developer T). For example, the downstream surface film 33*f*2 may be formed of polystyrene, which is a material located on the positive side of polyester (the predominant component of the developer T) and on the negative side of nylon in the triboelectric series shown in FIG. 4.

Moreover, in the above-described embodiment, the downstream surface film 33*f*2 is formed of a material which is the same as the predominant component of the developer T. However, the downstream surface film 33*f*2 may be formed of a material which charges the developer T to the positive polarity (positively charges the developer T) through friction between the downstream surface film 33*f*2 and the developer T such that the absolute value of the charge amount of the developer T becomes smaller than that in the assumed case in which the upstream surface film 33*f*1 is disposed in place of the downstream surface film 33*f*2. For example, the downstream surface film 33*f*2 may be formed of polyethylene or Teflon (registered trademark) which is a material located on the negative side of polyester (the predominant component of the developer T) and located relatively close to polyester in the triboelectric series shown in FIG. 4.

In the above-described embodiment, the upstream surface film 33*f*1 and the downstream surface film 33*f*2 are formed of different materials such that the degree of charge of the developer T through friction between the developer T and the transport surface TS (charging characteristic) differs between the upstream surface film 33*f*1 and the downstream surface film 33*f*2. However, the above-described embodiment may be modified in such a manner that the upstream surface film 33*f*1 and the downstream surface film 33*f*2 are formed of the same material, and an electrification control agent is added to at least one surface film so as to control the charge amount of the developer T, or at least one surface film is subjected to surface modification, whereby the charging characteristics of the upstream surface film 33*f*1 and the downstream surface film 33*f*2 are rendered different from each other.

Meanwhile, in the case where a substance (e.g., an electrification control agent (charging control agent, CCA), external additive, or the like) for controlling the charge amount of the developer T) added to the developer T affects the degree of charging of the developer T through friction between the developer T and the surface film 33*f* (charging characteristic) more greatly than does the predominant component of the developer, the above-described embodiment is desirably modified such that the material of the surface film is selected on the basis of the added substance (material) and the triboelectric series.

In the above-described embodiment, the developer T is negatively charged through friction between the developer T and the upstream surface film 33*f*1. However, the above-described embodiment may be modified such that the developer T is positively charged through friction between the developer T and the upstream surface film 33*f*1. In this case, preferably, the photoconductive layer 31*b* is formed of a positively chargeable material; the charger 41 and the transfer roller 51 are biased to a polarity opposite the polarity employed in the above-described embodiment; and the voltages generated by the power circuits VA to VD assume polarities opposite the polarities employed in the above-described embodiment. In addition, in this case, preferably, the upstream surface film 33*f*1 is formed of a material which positively charges the developer T through friction between the upstream surface film 33*f*1 and the developer T such that the absolute value of the charge amount of the developer T becomes relatively large, and the downstream surface film 33*f*2 is formed of a material which renders the absolute value of the charge amount of the developer T smaller than that in the assumed case in which the upstream surface film 33*f*1 is disposed in place of the downstream surface film 33*f*2.

Meanwhile, in the above-described embodiment, voltages generated by the power circuits VA to VD are of rectangular waveforms. However, the voltages may be of other waveforms, such as sine waveforms and triangular waveforms.

Further, the above-described embodiment employs four power circuits VA to VD configured such that voltages generated by the power circuits VA to VD shift 90° in phase from one another. However, the above-described embodiment may be configured to employ three power circuits configured such that voltages generated by the power circuits shift 120° in phase from one another.

Moreover, the transport-electric-field forming means of the above-described embodiment forms electric fields which collect the charged developer T in predetermined areas on the transport surface TS and which move the areas along the transport surface TS in the developer transport direction. However, the transport-electric-field forming means may form any electric field(s), so long as the formed electric field(s) transports the developer T in the developer transport direction such that the developer T supplied onto the transport surface TS passes through the closest proximity position P0. [2]

<Overall Configuration of Laser Printer>

Figure 10:
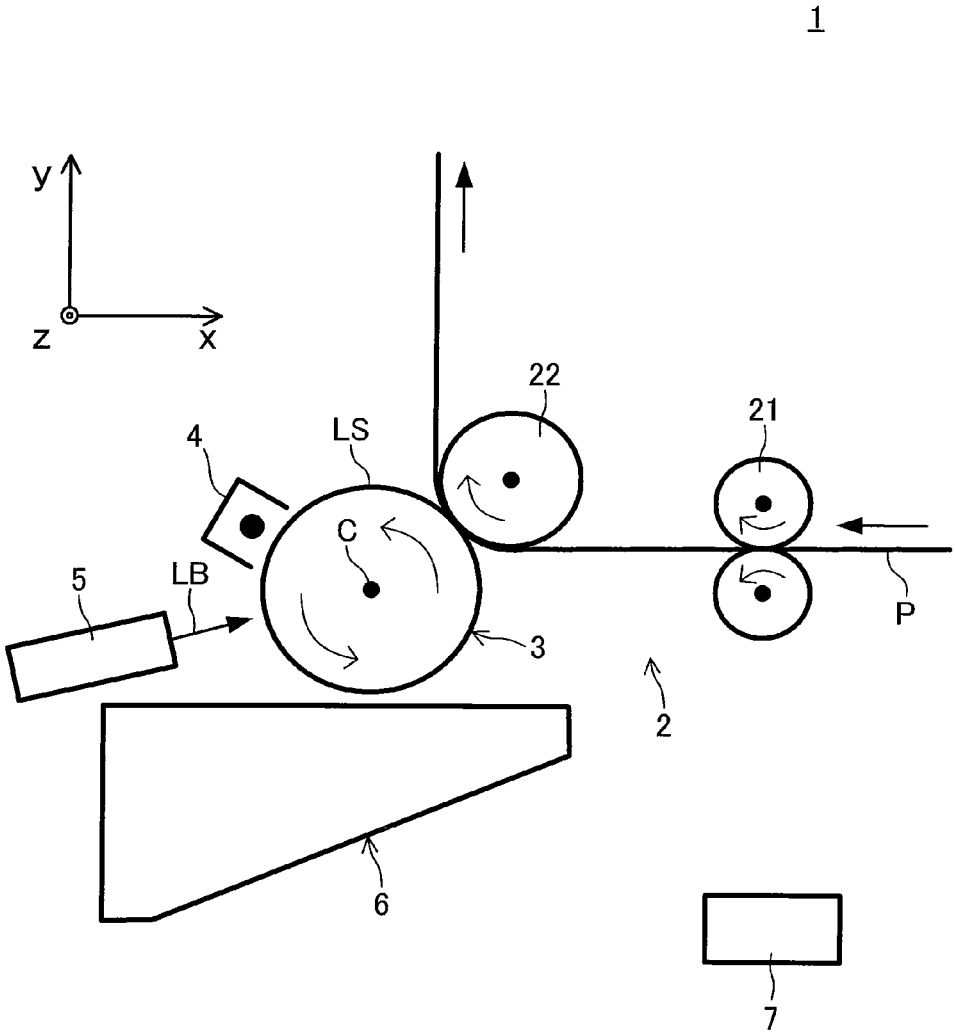
FIG. 10 is a side view schematically showing the configuration of a laser printer according to a second embodiment of the present invention.

FIG. 10 is a side view showing the schematic configuration of a laser printer 1 according to the present embodiment.

Referring to FIG. 10, the laser printer 1 includes a paper transport mechanism 2, a photoconductor drum 3, a charger 4, a scanner unit 5, and a toner supply apparatus 6, and a control section 7.

An unillustrated paper feed tray provided in the laser printer 1 contains sheets of paper P in a stacked state. The paper transport mechanism 2 is configured to be able to transport the paper P along a predetermined paper transport path.

A latent-image forming surface LS, which serves as the latent-image forming surface, the developer-image carrying surface, and the developer carrying surface of the present invention, is formed on the circumferential surface of the photoconductor drum 3, which serves as the electrostatic-latent-image carrying body, the developer-image carrying body, and the developer carrying body of the present invention. The latent-image forming surface LS assumes the form of a cylindrical surface parallel to a main scanning direction (z-axis direction in FIG. 10). The latent-image forming surface LS is configured to be able to form an electrostatic latent image thereon by means of electric potential distribution. The photoconductor drum 3 is configured to be able to be rotatably driven about a center axis C in a direction indicated by the arrow in FIG. 10, such that the latent-image forming surface LS can move along a sub-scanning direction orthogonal to the main scanning direction.

Notably, the "sub-scanning direction" is an arbitrary direction orthogonal to the main scanning direction. Usually, the sub-scanning direction can be a direction which intersects with a vertical direction. That is, the sub-scanning direction is a direction along a front-rear direction of the laser printer 1 (a direction orthogonal to a paper width direction and to a height direction; i.e., x-axis direction in FIG. 10).

The charger 4 is disposed in such a manner as to face the latent-image forming surface LS. The charger 4 is a corotron-type or scorotron-type charger and is configured to be able to uniformly and negatively charge the latent-image forming surface LS.

The scanner unit 5 is configured to generate a laser beam LB which is modulated according to image data. Also, the scanner unit 5 is configured to focus the generated laser beam LB on the latent-image forming surface LS at a scanning position SP (to expose the latent-image forming surface LS to light). The scanning position SP is located downstream of the charger 4 with respect to the rotational direction of the photoconductor drum 3 (counterclockwise direction in FIG. 10). Furthermore, the scanner unit 5 is configured to be able to move (sweep) the position on the latent-image forming surface LS at which the laser beam LB is focused, at a uniform velocity along the main scanning direction.

The toner supply apparatus 6, which serves as the developer supply apparatus of the present invention, is disposed in such a manner as to face the photoconductor drum 3. The toner supply apparatus 6 is configured to be able to supply onto the latent-image forming surface LS a negatively chargeable toner, which is a dry developer in the form of fine particles (power developer). A detailed configuration of the toner supply apparatus 6 will be described later.

The control section 7 includes a CPU, RAM, ROM, etc., and is configured to control drive of various sections provided in the laser printer 1 and control voltage outputs.

<Configurations of Various Sections of Laser Printer>

Next, specific configurations of various sections of the laser printer 1 will be described.

<<Paper Transport Mechanism>>

The paper transport mechanism 2 includes a pair of resist rollers 21 and a transfer roller 22.

The resist rollers 21 are configured to be able to send out the paper P at a predetermined timing toward a position between the photoconductor drum 3 and the transfer roller 22.

The transfer roller 22 is disposed in such a manner as to face the latent-image forming surface LS, which is the circumferential surface of the photoconductor drum 3, with the paper P nipped therebetween. The transfer roller 22 is configured to be able to be rotatably driven in a direction indicated by the arrow in FIG. 10 (clockwise). The transfer roller 22 is connected to an unillustrated bias power circuit, so that the transfer roller 22 is supplied with a predetermined transfer bias voltage for transferring the toner (developer) from the latent-image forming surface LS onto the paper P between the transfer roller 22 and the photoconductor drum 3.

<<Photoconductor Drum>>

Figure 11:
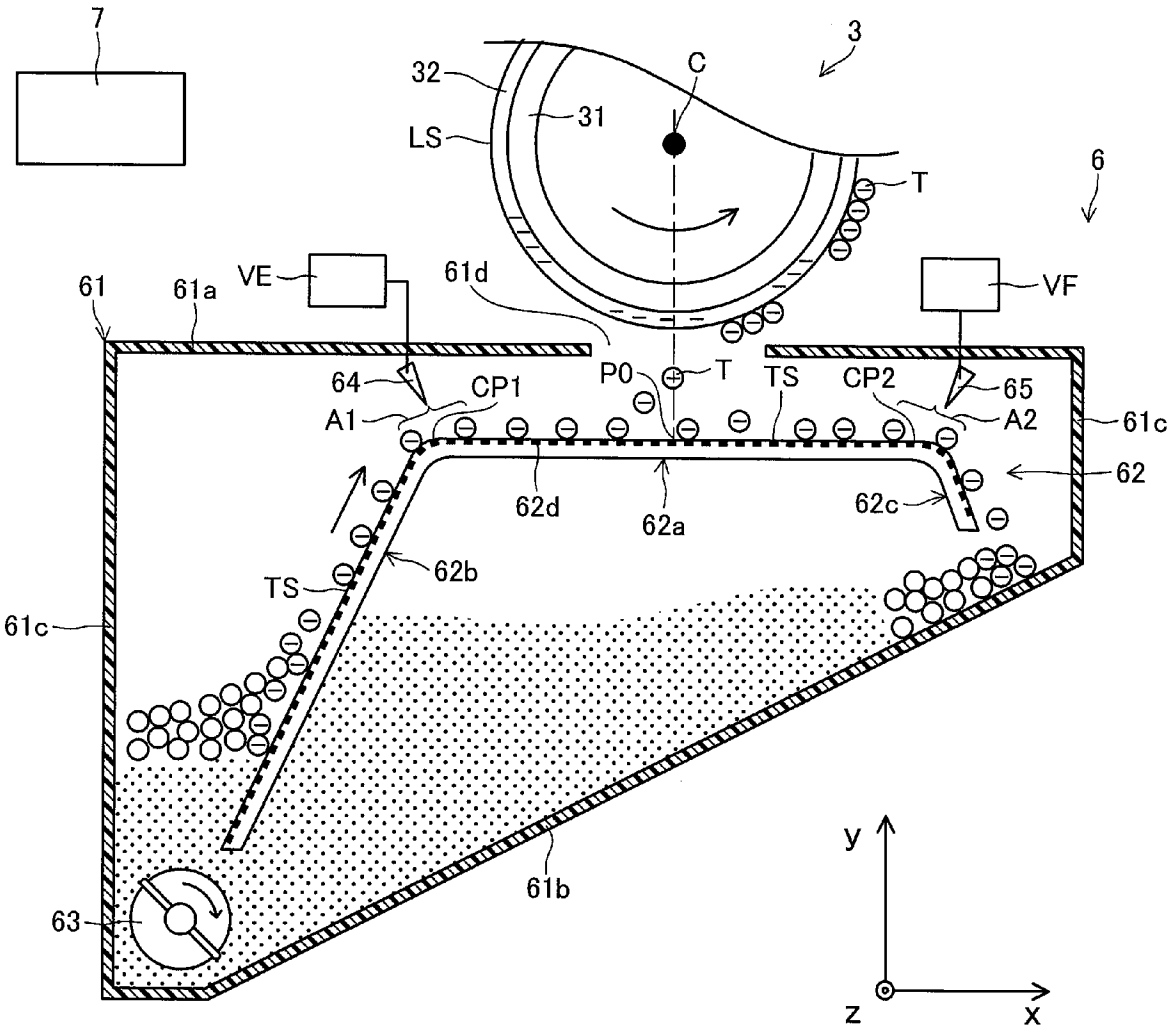
FIG. 11 is a side sectional view showing, on an enlarged scale, a region where a photoconductor drum and a toner supply apparatus shown in FIG. 10 face each other.

FIG. 11 is a side sectional view showing, on an enlarged scale, a region where the photoconductor drum 3 and the toner supply apparatus 6 shown in FIG. 10 face each other.

Referring to FIG. 11, the photoconductor drum 3 includes a drum body 31 and a photoconductive layer 32.

The drum body 31 is a cylindrical member having the center axis C parallel to the z-axis and is formed of a metal such as aluminum. The drum body 31 is grounded.

The photoconductive layer 32 is provided in such a manner as to cover the outer circumferential surface of the drum body 31. The photoconductive layer 32 is a negatively chargeable photoconductive layer which exhibits electron-conductivity upon exposure to a laser beam having a predetermined wavelength. The photoconductive layer 32 is formed of a synthetic resin such as polycarbonate doped with phthalocyanine-based dye or the like. The latent-image forming surface LS is formed by the outer circumferential surface of the photoconductive layer 32.

<<Toner Supply Apparatus>>

A toner box 61, which serves as the casing of the toner supply apparatus 6, is formed by a top plate 61*a*, a bottom plate 61*b*, and side plates 61*c*. A natively chargeable, non-magnetic one-component, black toner, which contains polyester as a predominant component, is charged into the toner box 61.

The top plate 61*a* is a rectangular plate-like member as viewed in plane and is disposed in parallel with a horizontal plane. The bottom plate 61*b* is a rectangular plate-like member as viewed in plane and is disposed under the top plate 61*a*. The bottom plate 61*b* is disposed in such an inclined manner as to rise in the y-axis positive direction toward the x-axis positive direction in FIG. 11. Four side edges of each of the top plate 61*a* and the bottom plate 61*b* are connected to the four side plates 61*c* (FIG. 11 shows only two side plates 61*c*), whereby the toner box 61 can contain the toner T in such a manner as not to allow leakage of the toner T to the exterior thereof.

The top plate 61*a* has a toner passage hole 61*d*. The toner passage hole 61*d* is formed at a position where the top plate 61*a* and the photoconductive layer 32 are close to each other.

As viewed in plane, the toner passage hole 61*d* assumes the form of a rectangle whose long sides have substantially the same length as the width of the photoconductive layer 32 along the main scanning direction (z-axis direction in FIG. 11) and whose short sides are in parallel with the sub-scanning direction (x-axis direction in FIG. 11). The toner passage hole 61*d* is formed as a through hole through which the toner T can pass when it moves from the interior of the toner box 61 toward the photoconductive layer 32 along the y-axis direction in FIG. 11.

<<Toner Transport Body>>

A toner transport body 62, which serves as the developer transport body of the present invention, is accommodated within the toner box 61. The toner transport body 62 is a plate-like member having a predetermined thickness. The toner transport body 62 includes a central constituent portion 62*a*, an upstream constituent portion 62*b*, and a downstream constituent portion 62*c*.

As viewed in plane, the central constituent portion 62*a* roughly assumes the form of a rectangle whose long sides is substantially the same as the width of the photoconductor drum 3 along the main scanning direction and whose short sides are longer than the diameter of the photoconductor drum 3. The central constituent portion 62*a* is provided at a position where its center with respect to the sub-scanning direction (x-axis direction in FIG. 11) coincides with the center of the toner passage hole 61*d* with respect to the sub-scanning direction. That is, the central constituent portion 62*a* is disposed approximately in parallel with the top plate 61*a* in such a manner as to face the latent-image forming surface LS with the toner passage hole 61*d* therebetween.

The upstream constituent portion 62*b* extends upstream and obliquely downward from an upstream end portion of the central constituent portion 62*a* with respect to a toner transport direction (x-axis positive direction in FIG. 11). That is, the upstream constituent portion 62*b* is a plate-like member disposed in such a manner as to obliquely rise toward the central constituent portion 62*a*. The upstream constituent portion 62*b* is provided such that its most upstream end portion with respect to the toner transport direction reaches the vicinity of a deepest portion of the toner box 61. Therefore, even when the amount of the toner T becomes slight, a portion (a lower end portion) of the upstream constituent portion 62*b* is buried in the toner T.

The downstream constituent portion 62*c* extends downstream and obliquely downward from a downstream end portion of the central constituent portion 62*a* with respect to the toner transport direction. That is, the downstream constituent portion 62*c* is a plate-like member disposed in such a manner as to obliquely lower with distance from the central constituent portion 62*a*. Further, the downstream constituent portion 62*c* is provided such that its most downstream end portion with respect to the toner transport direction reaches a position which is located near the bottom plate 61*b* of the toner box 61 and near the side plate 61*c* located at the most downstream end with respect to the toner transport direction (i.e., in the vicinity of a shallowest portion of the toner box 61), whereby the toner T can smoothly return to the bottom plate 61*b*.

The toner transport body 62 has a toner transport surface TS parallel to the main scanning direction. The toner transport body 62 is disposed such that the toner transport surface TS faces the latent-image forming surface LS of the photoconductor drum 3.

A plurality of transport electrodes 62*d* are formed along the toner transport surface TS (to be located near the toner transport surface TS). The transport electrodes 62*d* are in the form of a strip-shaped wiring pattern formed of metal foil, and are provided in parallel with each other such that their longitudinal direction coincides with the main scanning direction. These transport electrodes 62*d* are arrayed along the sub-scanning direction at constant intervals.

Figure 12:
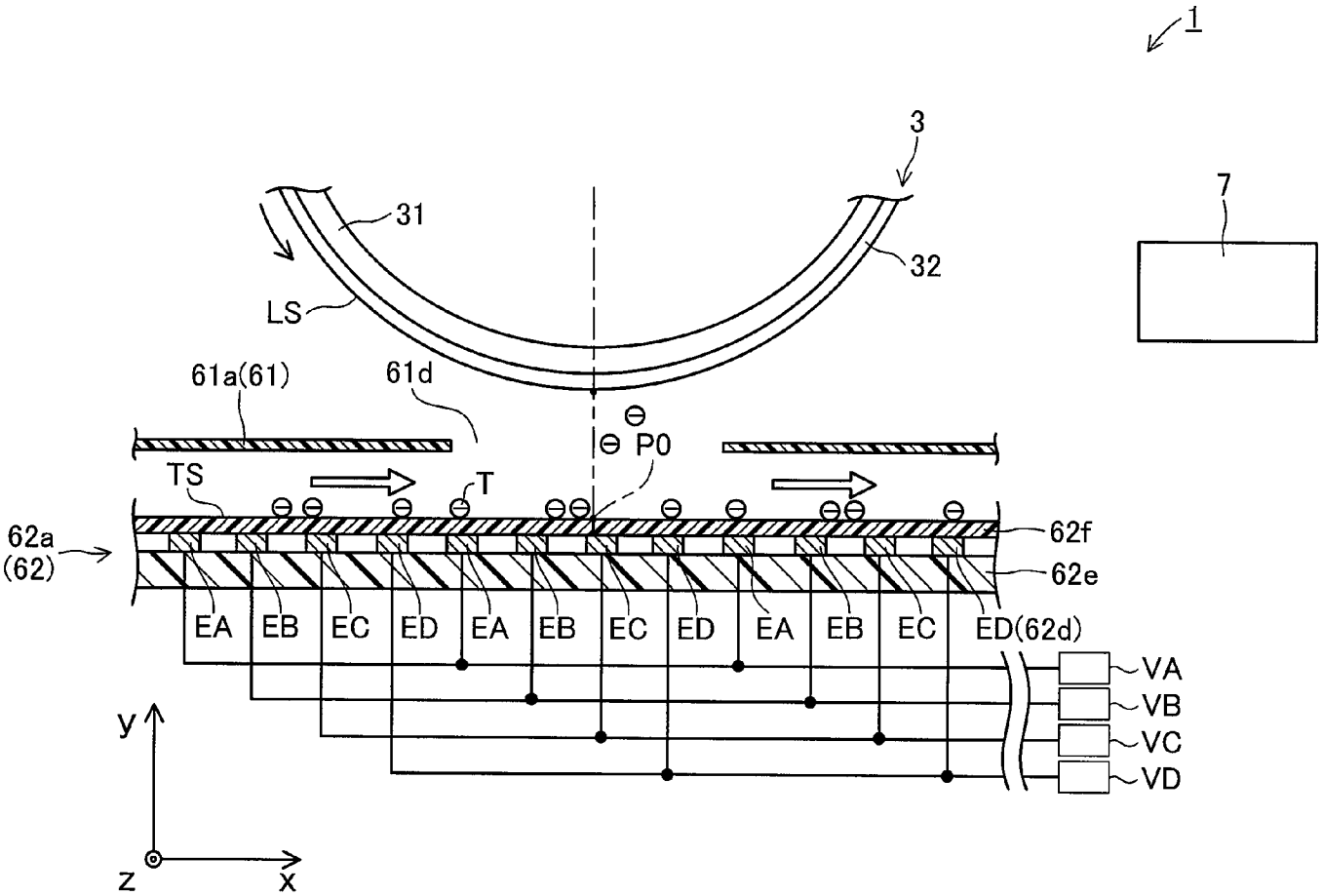
FIG. 12 is a side sectional view showing, on an enlarged scale, a region where a toner transport body and the photoconductor drum shown in FIG. 11 face each other.

FIG. 12 is a side sectional view showing, on an enlarged scale, a region where the toner transport body 62 and the photoconductor drum 3 shown in FIG. 11 face each other.

Referring to FIG. 12, the laser printer 1 includes four electricity supply sections for transport (hereinafter referred to as "transport electricity supply sections") VA to VD, which are power circuits for supplying electricity to the transport electrodes 62*d*. A large number of the transport electrodes 62*d* arrayed along the sub-scanning direction (x-axis direction in FIG. 12) are connected to the transport electricity supply sections such that every fourth transport electrode 62*d* is connected to the same transport electricity supply section.

Specifically, a transport electrode EA connected to the transport electricity supply section VA, a transport electrode EB connected to the transport electricity supply section VB, a transport electrode EC connected to the transport electricity supply section VC, a transport electrode ED connected to the transport electricity supply section VD, another transport electrode EA connected to the transport electricity supply section VA, another transport electrode EB connected to the transport electricity supply section VB . . . are sequentially arrayed along the sub-scanning direction. In FIG. 12, the transport electrodes 62*d* which are connected to the transport electricity supply section VA are referred to as the transport electrodes EA. The same convention also applies to the transport electrodes EB to ED.

Figure 13:
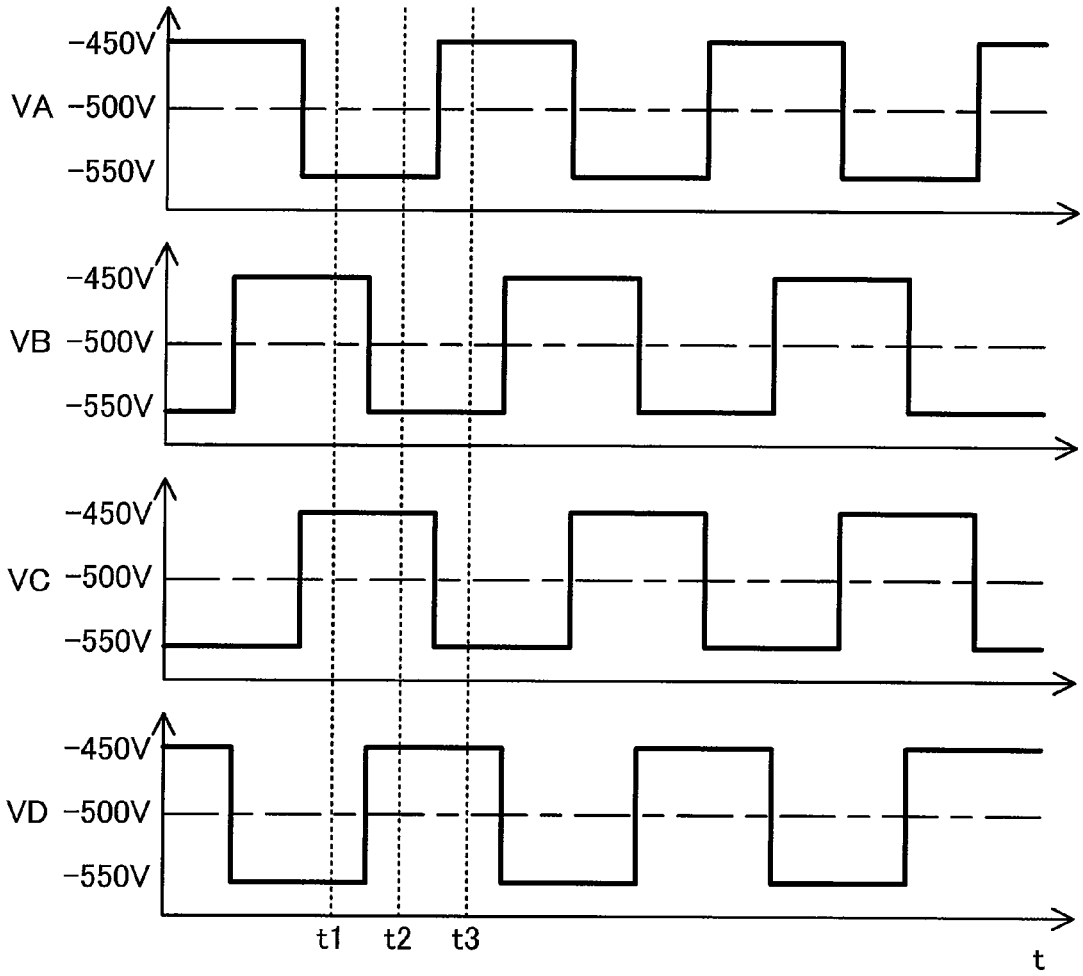
FIG. 13 is a set of graphs showing waveforms of voltages generated by transport electricity supply sections VA to VD shown in FIG. 12.

FIG. 13 is a set of graphs showing waveforms of voltages generated by the transport electricity supply sections VA to VD shown in FIG. 12. As shown in FIG. 13, the transport electricity supply sections VA to VD are configured to be able to generate AC voltages of substantially the same waveform. Also, the transport electricity supply sections VA to VD are configured such that the waveforms of voltages generated by the transport electricity supply sections VA to VD shift 90° in phase from one another.

That is, referring to FIGS. 12 and 13, the transport electricity supply sections VA to VD are controlled by the control section 7 shown in FIG. 12 such that, in the sequence of the transport electricity supply sections VA to VD, the phase of voltage delays in increments of 90°.

As described above, the transport electrodes 62*d* are configured and arranged in such a manner that, upon application of traveling-wave voltages (voltages which travel like traveling waves) by the transport electricity supply sections VA to VD whose output operations are controlled by the control section 7, the transport electrodes 62*d* can form traveling-wave electric fields (electric fields which travel like traveling waves) which can transport the toner T on the toner transport surface TS in the toner transport direction.

Referring to FIG. 12, the transport electrodes 62*d* are formed on a support plate 62*e*, which is a plate-like member formed of a synthetic resin. The surface of the support plate 62*e*, on which the transport electrodes 62*d* are formed, is covered with a coating film 62*f* formed of nylon, which is a synthetic resin. The toner transport surface TS is formed by the surface of the synthetic resin coating film 62*f*.

Referring to FIG. 11, an agitator 63, which is an agitating element, is disposed in a deepest portion of the toner box 61 to be located below the lower end portion of the upstream constituent portion 62*b* of the toner transport body 62. The agitator 63 is configured to be able to rotate in a direction indicated by the arrow in FIG. 11 (clockwise) so as to agitate and fluidize the developer T in the deepest portion of the toner box 61 and cause friction between the developer T and the toner transport surface TS, to thereby charge the toner T to the negative polarity.

A first electrical charge draining member 64 and a second electrical charge draining member 65 are provided such that they face the toner transport surface TS of the center constituent portion 62*a* of the toner transport body 62. The first and second electrical charge draining members 64 and 65 are configured to be able to restrain, through aerial discharge, charge up on the toner transport surface TS, which is a surface formed of a synthetic resin.

The first electrical charge draining member 64 is disposed such that it faces an end portion of the center constituent portion 62*a*, the end portion being located upstream (with respect to the toner transport direction) of a closest proximity position P0 where the distance between the latent-image forming surface LS and the toner transport surface TS becomes the shortest. The second electrical charge draining member 65 is disposed such that it faces an end portion of the center constituent portion 62*a*, the end portion being located downstream (with respect to the toner transport direction) of the closest proximity position P0 where the distance between the latent-image forming surface LS and the toner transport surface TS becomes the shortest.

The first electrical charge draining member 64 is electrically connected to a first electricity supply section for electrical charge draining VE. The second electrical charge draining member 65 is electrically connected to a second electricity supply section for electrical charge draining VF. The first electricity supply section for electrical charge draining VE and the second electricity supply section for electrical charge draining VF are configured to be able to supply electricity to the first electrical charge draining member 64 and the second electrical charge draining member 65 under the control of the control section 7. The first electricity supply section for electrical charge draining VE and the second electricity supply section for electrical charge draining VF are configured to be able to output AC voltages whose reference voltage is 0 V.

Figure 14:
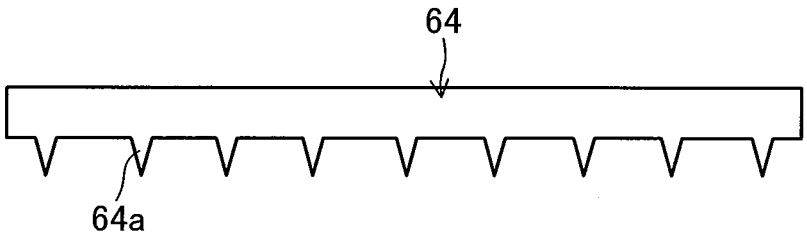
FIG. 14 is a front view of a first electrical charge draining member shown in FIG. 11.

FIG. 14 is a front view of the first electrical charge draining member 64 shown in FIG. 11 (the second electrical charge draining member 65 has a similar configuration). Referring to FIG. 14, the first electrical charge draining member 64 is a bar-shaped metal member whose longitudinal direction coincides with the main scanning direction. A plurality of sharp projections 64*a* are formed at a lower end portion of the first electrical charge draining member 64. That is, the first electrical charge draining member 64 is constituted by a comb-shaped electrode member.

<Operation of Laser Printer>

Next, operation of the laser printer 1 having the above-described configuration will be described with reference to the relevant drawings. Notably, although not mentioned in the following description of the operation, operations of all the sections of the laser printer 1 (the paper transport mechanism 2, the photoconductor drum 3, the charger 4, the scanner unit 5, the toner supply apparatus 6, and various power supply sections) are controlled by the control section 7.

<<Paper Feed Operation>>

First, referring to FIG. 10, the leading end of the paper P stacked on an unillustrated paper feed tray is sent to the resist rollers 21. The resist rollers 21 correct a skew of the paper P and adjust transport timing. Subsequently, the paper P is transported to the transfer position, at which the photoconductor drum 3 and the transfer roller 22 face each other.

<<Carrying Toner Image onto Latent-Image Forming Surface>>

While the paper P is being transported toward the transfer position as described above, an image in the toner T is formed as described below on the latent-image forming surface LS, which is the circumferential surface of the photoconductor drum 3.

<<Formation of Electrostatic Latent Image>>

First, the charger 4 uniformly charges a portion of the latent-image forming surface LS of the photoconductor drum 3 to the negative polarity.

As a result of rotation of the photoconductor drum 3 in the direction (counterclockwise) indicated by the arrow in FIG. 10, the portion of the latent-image forming surface LS which has been charged by the charger 4 moves along the sub-scanning direction to the scanning position SP, where the portion of the latent-image forming surface LS faces (faces straight toward) the scanner unit 5. At the scanning position, the charged portion of the latent-image forming surface LS is irradiated with the laser beam LB modulated on the basis of image information, while the laser beam LB sweeps along the main scanning direction. Certain negative charges are lost from the charged portion of the latent-image forming surface LS according to a state of modulation of the laser beam LB. By this procedure, an electrostatic latent image in the form of an imagewise distribution of negative charges is formed on the latent-image forming surface LS.

As a result of rotation of the photoconductor drum 3 in the direction (counterclockwise) indicated by the arrow in FIG. 10, the electrostatic latent image formed on the latent-image forming surface LS moves to a position where the electrostatic latent image faces the toner supply apparatus 6.

<<<Transport and Supply of Charged Toner>>>

Referring to FIG. 11, the agitator 63 rotates in the direction (clockwise) indicated by the arrow in FIG. 11. As a result of rotation of the agitator 63, friction occurs between the toner T and the toner transport surface TS (surface of the synthetic resin coating film in FIG. 12) of the upstream constituent portion 62*b*. Thus, the toner T is charged to the negative polarity.

As mentioned previously, the end portion of the toner transport body 62 (upstream constituent portion 62*b*) on the upstream side with respect to the toner transport direction (on the side toward the x-axis negative direction in FIG. 11) is buried in the toner T. Thus, the toner T contained in the toner box 61 is supplied at all times onto the toner transport surface TS.

Also, traveling-wave voltages are applied to the plurality of transport electrodes 62*d* of the toner transport body 62. Accordingly, predetermined traveling-wave electric fields are formed on the toner transport surface TS. By the effect of the traveling-wave electric fields, the negatively charged toner T moves up along the inclined toner transport surface TS of the upstream constituent portion 62*b*, and reaches the center constituent portion 62*a*. Subsequently, the toner T is transported to the closest proximity position P0.

Figure 15:
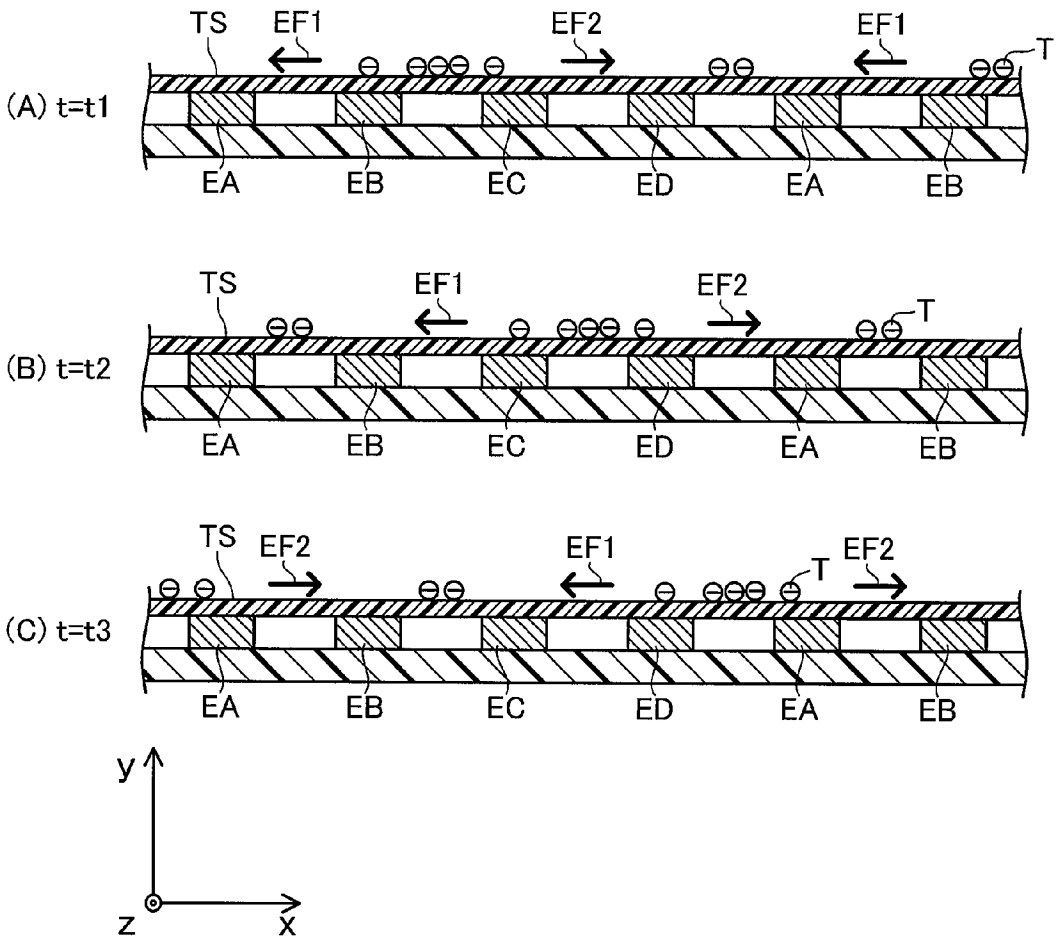
FIG. 15 is a set of side sectional views each showing, on an enlarged scale, a portion of the toner transport body shown in FIG. 12, the portion being located in the vicinity of a closest proximity position P0.

FIG. 15 is a set of side sectional views each showing, on an enlarged scale, a portion of the toner transport body 62 shown in FIG. 12, the portion being located in the vicinity of the closest proximity position P0.

Referring to FIGS. 13 and 15, at time t1 in FIG. 13, an electric field EF1 directed opposite the toner transport direction (directed in the x-axis negative direction in FIG. 15) is formed in a section AB between the transport electrode EA and the transport electrode EB, as shown in section (A) of FIG. 15. Meanwhile, an electric field EF2 directed in the toner transport direction (in the x-axis positive direction in FIG. 15)

is formed in a section CD between the transport electrode EC and the transport electrode ED. No electric field directed along the toner transport direction is formed in a BC section between the transport electrode EB and the transport electrode EC and in a DA section between the transport electrode ED and the transport electrode EA.

That is, at time t1, the negatively charged toner T in the sections AB is subjected to an electrostatic force directed in the same direction as the toner transport direction. The negatively charged toner T in the sections BC and DA is hardly subjected to an electrostatic force directed along the toner transport direction. The negatively charged toner T in the CD sections is subjected to an electrostatic force directed opposite to the toner transport direction. Thus, at time t1, the negatively charged toner T is collected in the BC sections.

Similarly, at time t2, the negative charged toner T is collected in the sections CD. When time t3 is reached, the negatively charged toner T is collected in the sections DA. That is, with elapse of time, areas where the toner T is collected move along the toner transport surface TS in the toner transport direction.

In this manner, by means of voltages shown in FIG. 13 being applied to the transport electrodes 62*d* (EA to ED), traveling-wave electric fields are formed on the toner transport surface TS. Thus, the positively charged toner T is transported in the toner transport direction (in the x-axis positive direction in FIG. 15) while hopping in the y-axis direction in FIG. 15.

<<<Development of Electrostatic Latent Image>>>

Referring to FIG. 11, as described above, the negatively charged toner T moves up along the inclined toner transport surface TS of the upstream constituent portion 62*b*, and reaches the center constituent portion 62*a*. Subsequently, the toner T is transported to the closest proximity position P0.

In the vicinity of the closest proximity position P0, the electrostatic latent image formed on the latent-image forming surface LS is developed by the toner T. That is, the toner T adheres to portions of the electrostatic latent image on the latent-image forming surface LS at which negative charges are lost. Thus, an image in the toner T (hereinafter referred to as the "toner image") is carried on the latent-image forming surface LS.

Notably, the remaining toner T not used for development of the electrostatic latent image is transported toward the downstream constituent portion 62*c*. The toner T then falls downward from the downstream constituent portion 62*c*, and returns to the bottom portion of the toner box 61.

<<Transfer of Toner Image from Latent-Image Forming Surface to Paper>>

Referring to FIG. 10, as a result of rotation of the latent-image forming surface LS in the direction (counterclockwise) indicated by the arrow in FIG. 10, the toner image which has been carried on the latent-image forming surface LS of the photoconductor drum 3 as mentioned above is transported toward the transfer position. At the transfer position, the toner image is transferred from the latent-image forming surface LS onto the paper P.

<<Operation of Removing Electricity from Toner Transport Surface>>

Next, an electrical charge draining operation for restraining charge up of the toner transport surface TS will be described with reference to FIG. 11.

As described above, the toner T, which is formed of a synthetic resin, is transported in the toner transport direction on the toner transport surface TS, which is a surface formed of a synthetic resin. At that time, due to friction between the toner T and the toner transport surface TS, the toner transport surface TS may be charged up. If such a charge up occurs, the toner T strongly adheres to the toner transport surface TS by the action of electrostatic force, whereby smooth transport of the toner T on the toner transport surface TS may be hindered.

In view of the above, during non-developing periods in which development of an electrostatic latent image is not performed, the first electricity supply section for electrical charge draining VE and the second electricity supply section for electrical charge draining VF apply AC voltages (reference voltage: 0 V) to the first electrical charge draining member 64 and the second electrical charge draining member 65. As a result, electrical charge is drained from an upstream electrical charge draining area A1 and a downstream electrical charge draining area A2 of the toner transport surface TS, the areas A1 and A2 facing the first electrical charge draining member 64 and the second electrical charge draining member 65, respectively. Notably, at that time, electrical charge is drained from the toner T on the upstream and downstream electrical charge draining areas A1 and A2 to a proper degree.

The upstream electrical charge draining area A1 may be an area which is in the vicinity a facing position CP1 where the first electrical charge draining member 64 and the toner transport surface TS face in the closest proximity to each other and which slightly extends from the facing position CP1 toward the upstream and downstream sides with respect to the toner transport direction. Similarly, the downstream electrical charge draining area A2 may be an area which extends from a position located upstream of a facing position CP2 with respect to the toner transport direction to a position located downstream of the facing position CP2 with respect to the toner transport direction.

During the electrical charge draining operation, supply of electricity to the transport electrodes 62*d* located upstream of the upstream electrical charge draining area A1 with respect to the toner transport direction is stopped. As a result, generation of the traveling-wave electric fields is stopped on a portion of the toner transport surface TS located upstream of the upstream electrical charge draining area A1 with respect to the toner transport direction. Thus, transport of the toner T toward the upstream electrical charge draining area A1 is stopped. Therefore, electrical charge draining in the upstream electrical charge draining area A1 can be performed efficiently.

Meanwhile, electricity is supplied to the transport electrodes 62*d* located in the upstream electrical charge draining area A1 and those located downstream of the upstream electrical charge draining area A1 with respect to the toner transport direction. As a result, the toner T from which electrical charge has been drained to a proper degree and whose electrification has been relaxed is transported to the downstream side with respect to the toner transport direction, whereby the toner T returns to the bottom portion (bottom plate 61*b*) of the toner box 61 via the downstream constituent portion 62*c*.

Further, during developing periods in which development of an electrostatic latent image is performed and during preparation stages for the development, the first electricity supply section for electrical charge draining VE and the second electricity supply section for electrical charge draining VF maintain the first electrical charge draining member 64 and the second electrical charge draining member 65 at a negative potential, which is the same polarity as the toner T. Thus, adhesion of the toner T to the first electrical charge draining member 64 and the second electrical charge draining member 65 is restrained.

<Modifications>

The above-described embodiment is, as mentioned previously, a mere typical example which the applicant of the present invention contemplated as the best at the time of filing the present application. Thus, the present invention is not limited to the above-descried embodiment. Therefore, needless to say, various modifications to the above-described embodiment are possible so long as the invention is not modified in essence.

Several typical modifications will be cited below. In the following description of the modifications, members having similar structures and functions as those described in the above-described embodiment are denoted by the same reference numerals as those used in the embodiment. For such members, corresponding descriptions in the above-described embodiment can be cited so long as no technical inconsistencies are involved.

Needless to say, even modifications are not limited to those cited below. Also, a plurality of modifications can be combined as appropriate so long as no technical inconsistencies are involved.

The above-described embodiment and the following modifications should not be construed as limiting the present invention (particularly, those components which partially constitute the means for solving the problems to be solved by the invention and are illustrated with respect to operations and functions). Such limiting construal is impermissible, since it unfairly impairs the interests of an applicant (who is motivated to file as quickly as possible under the first-to-file system) and unfairly benefits imitators, and is adverse to the purpose of the Patent Law of protecting and utilizing inventions.

(1) Application of the present invention is not limited to a monochromatic laser printer. For example, the present invention can be preferably applied to so-called electrophotographic image forming apparatus, such as color laser printers and monochromatic and color copying machines. At this time, the shape of a photoconductor is not limited to a drum shape as in the above-described embodiment. For example, the photoconductor may assume the form of a flat plate or an endless belt.

Also, the present invention can be preferably applied to image forming apparatus of other than the above-mentioned electrophotographic system (for example, image forming systems which do not use photoconductor, such as a toner jet system, an ion flow system, and a multistylus electrode system).

(2) The outputs of the first electricity supply section for electrical charge draining VE and the second electricity supply section for electrical charge draining VF are not required to be AC voltages, and no limitation is imposed on the polarities of the outputs.

(3) No particular limitation is imposed on the arrangement and structure of the electrical charge draining members (the first electrical charge draining member 64 and the second electrical charge draining member 65). For example, the electrical charge draining members have a structure similar to that of a corotron-type or scorotron-type charger.

Figure 16:
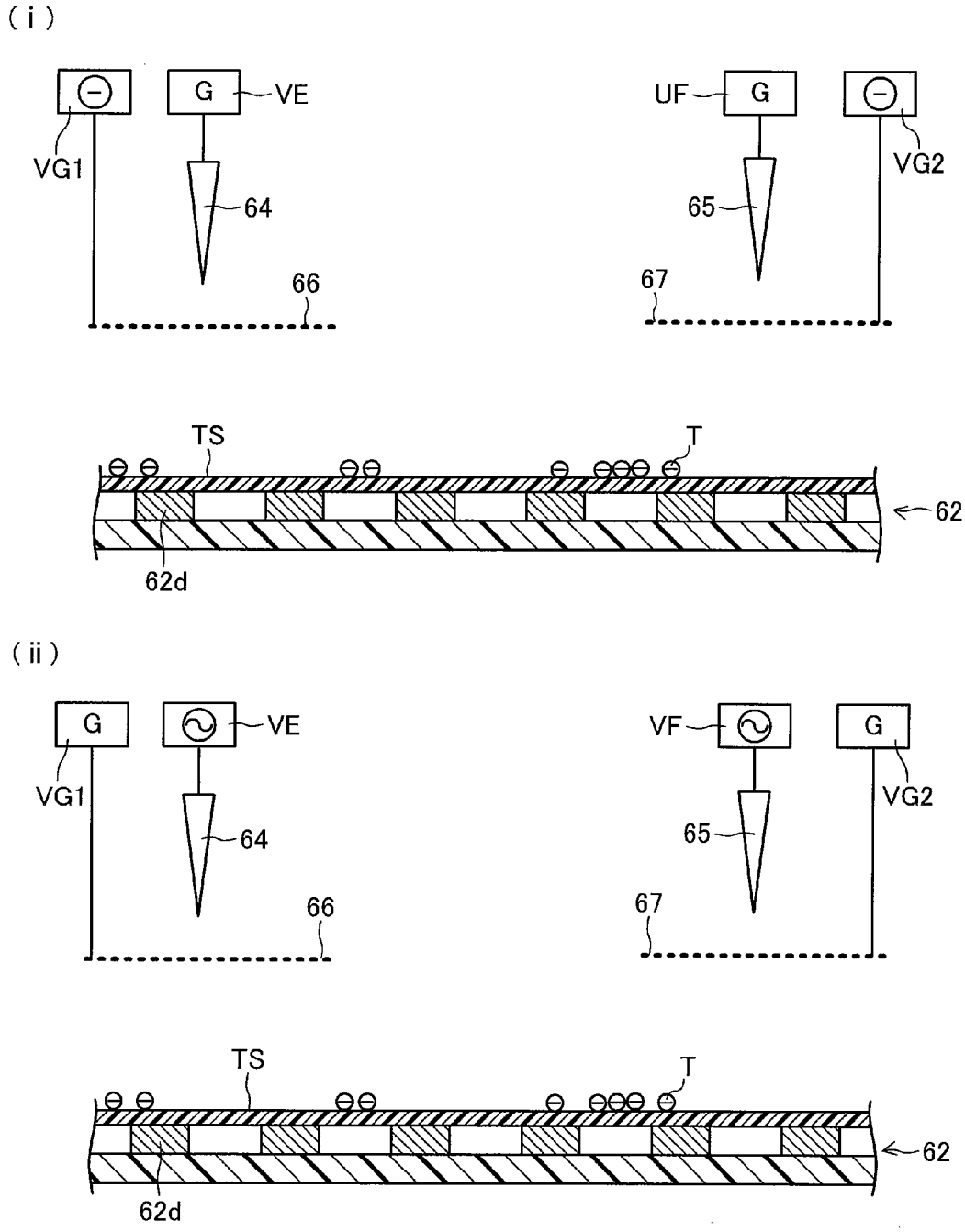
FIG. 16 is a pair of side sectional views showing a modification of the structure of a portion of the toner supply apparatus shown in FIG. 11 around first and second electrical charge draining members thereof.

FIG. 16 is a pair of side sectional views showing a modification of the structure of a portion of the toner supply apparatus 6 shown in FIG. 11 around the first and second electrical charge draining members 64 and 65 thereof.

As shown in FIG. 16, a first grid electrode 66 may be provided such that it faces the first electrical charge draining member 64. This first grid electrode 66 is electrically connected to an electricity supply section for grid VG1. Further, a second grid electrode 67 may be provided such that it faces the second electrical charge draining member 65. This second grid electrode 67 is electrically connected to an electricity supply section for grid VG2.

In such a configuration, the following operations are performed during developing periods and non-developing periods, respectively.

As shown in section (i) of FIG. 16, during developing periods, the first electricity supply section for electrical charge draining VE and the second electricity supply section for electrical charge draining VF stop supply electricity to the first electrical charge draining member 64 and the second electrical charge draining member 65*d*. At that time, the electricity supply section for grid VG1 and the electricity supply section for grid VG2 set the potentials of the first grid electrode 66 and the second grid electrode 67 to a negative potential, which is the same as the potential of the toner T. Thus, adhesion of the toner T to the first electrical charge draining member 64, the second electrical charge draining member 65, the first grid electrode 66, and the second grid electrode 67 is restrained. Further, undesired lifting of the toner T from the toner transport surface TS is restrained.

As shown in section (ii) of FIG. 16, during non-developing periods, the first electricity supply section for electrical charge draining VE and the second electricity supply section for electrical charge draining VF supply electricity to the first electrical charge draining member 64 and the second electrical charge draining member 65. At that time, the electricity supply section for grid VG1 and the electricity supply section for grid VG2 set the potentials of the first grid electrode 66 and the second grid electrode 67 to the ground potential (GND: 0 V). With this, removal of electricity from the toner transport surface TS can be performed more stably.

One of the first electrical charge draining member 64 and the second electrical charge draining member 65 may be omitted. Alternatively, a plurality of electrical charge draining members may be provided on the upstream side or downstream side of the closest proximity position P0 with respect to the toner transport direction.

Further, an electrical charge draining member may be provided such that its faces a facing area of the toner transport surface TS (area near the closest proximity position P0) in which the toner transport surface TS faces the photoconductor drum 3. In this case, proper determination of the shape of the electrical charge draining member enables the electrical charge draining member to be disposed in the facing area well, without hindering development of an electrostatic latent image.

Further, the electrical charge draining member may be composed of a grid electrode only. In this case, proper adjustment of the shape of the grid electrode (the thickness of wire-like members which constitute the grid, the distance between the wire-like members, the mesh size, etc.) enables the electrical charge draining member to be disposed below the toner passage hole 61*d*, without hindering development of an electrostatic latent image.

(4) In the above-described embodiment, voltages generated by the transport electricity supply sections VA to VD are of rectangular waveforms. However, the voltages may be of other waveforms, such as sine waveforms and triangular waveforms.

The above-described embodiment employs four transport electricity supply sections VA to VD which are configured such that voltages generated by the transport electricity supply sections VA to VD shift 90° in phase from one another. However, three transport electricity supply sections may be provided and configured such that voltages generated by the transport electricity supply sections shift 120° in phase from one another.

(5) Although they are not mentioned specifically, variations other than those mentioned above are possible without departing from the gist of the present invention.

Those components which partially constitute the means for solving the problems to be solved by the invention and are represented operationally and functionally encompass not only the specific structures disclosed in the above-described embodiment and modifications but also any other structures that can implement the operations and functions of the components.

The invention claimed is:

1. A developer transport body comprising:

a substrate having a transport surface that faces a latent-image forming surface, the latent-image forming surface corresponding to a surface of a latent-image carrying body on which an electrostatic latent image is formable by electrical potential of the surface; and transport-electric-field forming means for forming an electric field for transporting a developer supplied onto the transport surface from a predetermined upstream area toward a predetermined downstream area such that the developer passes through a closest proximity position, which is a position on the transport surface where which the distance between the transport surface and the latent-image forming surface becomes the shortest, wherein the transport surface includes:

a first constituent surface formed by a first film and configured to charge the developer through contact with the developer, a downstream end portion of the first constituent surface with respect to a developer transport direction, which is a direction directed from the upstream area toward the downstream area, being located within a predetermined area including the closest proximity position; and a second constituent surface formed by a second film and disposed in an adjacent area downstream of the first constituent surface with respect to the developer transport direction and adjacent to the first constituent surface, the second constituent surface being configured to render the absolute value of a charge amount of the developer within the adjacent area to be smaller than the absolute value of a charge amount of the developer in the upstream area, wherein a material of the first film is different from a material of the second film.

2. The developer transport body according to claim 1, wherein the downstream end portion of the first constituent surface with respect to the developer transport direction is located within a projection area, which is formed on the transport surface by means of projecting the latent-image carrying body onto the transport surface in a projection direction parallel to a line which passes through a position on the latent-image forming surface where the distance between the transport surface and the latent-image forming surface becomes the shortest, and the closest proximity position.

3. The developer transport body according to claim 2, wherein the downstream end portion of the first constituent surface with respect to the developer transport direction is located at the closest proximity position or downstream of the closest proximity position with respect to the developer transport direction.

4. A process unit comprising:

a developer transport body; and a latent-image carrying body, wherein the developer transport body includes:

a substrate having a transport surface that faces a latent-image forming surface on which an electrostatic latent image is formable by electrical potential of the surface, the latent-image forming surface corresponding to a surface of the latent-image carrying body; and transport-electric-field forming means for forming an electric field for transporting a developer supplied onto the transport surface from a predetermined upstream area toward a predetermined downstream area such that the developer passes through a closest proximity position, is-the closest proximity position corresponding to a position on the transport surface where a distance between the transport surface and the latent-image forming surface becomes the shortest, wherein the transport surface includes:

a first constituent surface formed by a first film and configured to charge the developer through contact with the developer, a downstream end portion of the first constituent surface with respect to a developer transport direction, which is a direction directed from the upstream area toward the downstream area, being located within a predetermined area including the closest proximity position; and a second constituent surface formed by a second film and disposed in an adjacent area which is located downstream of the first constituent surface with respect to the developer transport direction and adjacent to the first constituent surface, the second constituent surface being configured to render the absolute value of a charge amount of the developer within the adjacent area to be smaller than the absolute value of a charge amount of the developer in the upstream area, wherein a material of the first film is different from a material of the second film, and wherein the process unit is configured to supply the transported developer onto the latent-image forming surface, to thereby form an image in the developer on the latent-image forming surface.

5. The process unit according to claim 4, wherein the downstream end portion of the first constituent surface with respect to the developer transport direction is located within a projection area, which is formed on the transport surface by means of projecting the latent-image carrying body onto the transport surface in a projection direction parallel to a line which passes through a position on the latent-image forming surface where the distance between the transport surface and the latent-image forming surface becomes the shortest, and the closest proximity position.

6. The process unit according to claim 5, wherein the downstream end portion of the first constituent surface with respect to the developer transport direction is located at the closest proximity position or downstream of the closest proximity position with respect to the developer transport direction.

7. An image forming apparatus comprising:

a developer transport body including a substrate having a transport surface facing a latent-image forming surface on which an electrostatic latent image is formable by electrical potential of the surface, the latent-image forming surface corresponding to a surface of a latent-image carrying body, and transport-electric-field forming means for forming an electric field for transporting a developer supplied onto the transport surface from a predetermined upstream area toward a predetermined downstream area such that the developer passes through a closest proximity position, the closest proximity position corresponding to a position on the transport surface where a distance between the transport surface and the latent-image forming surface becomes the shortest;

the latent-image carrying body;

electrostatic-latent-image forming means for forming on the latent-image forming surface the electrostatic latent image for adhering the developer to a predetermined position on the latent-image forming surface by means of an electrostatic force; and image forming means for transferring the image in the developer formed on the latent-image forming surface to a recording medium to thereby form an image on the recording medium, wherein the transport surface includes:

a first constituent surface formed by a first film and configured to charge the developer through contact with the developer, a downstream end portion of the first constituent surface with respect to a developer transport direction, which is a direction directed from the upstream area toward the downstream area, being located within a predetermined area including the closest proximity position; and a second constituent surface formed by a second film and disposed in an adjacent area downstream of the first constituent surface with respect to the developer transport direction and adjacent to the first constituent surface, the second constituent surface being configured to render the absolute value of a charge amount of the developer within the adjacent area to be smaller than the absolute value of a charge amount of the developer in the upstream area, and wherein a material of the first film is different from a material of the second film.

8. The image forming apparatus according to claim 7, wherein the downstream end portion of the first constituent surface with respect to the developer transport direction is located within a projection area, which is formed on the transport surface by means of projecting the latent-image carrying body onto the transport surface in a projection direction parallel to a line which passes through a position on the latent-image forming surface where the distance between the transport surface and the latent-image forming surface becomes the shortest, and the closest proximity position.

9. The image forming apparatus according to claim 8, wherein the downstream end portion of the first constituent surface with respect to the developer transport direction is located at the closest proximity position or downstream of the closest proximity position with respect to the developer transport direction.

* * * * *

UNITED STATES PATENT AND TRADEMARK OFFICE

CERTIFICATE OF CORRECTION

PATENT NO. : 8,600,270 B2
APPLICATION NO. : 12/307006
DATED : December 3, 2013
INVENTOR(S) : Kenjiro Nishiwaki It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1218 days.

Signed and Sealed this
Twenty-second Day of September, 2015

Michelle K. Lee

Michelle K. Lee
*Director of the United States Patent and Trademark Office*